US012092088B2

(12) United States Patent
Kay

(10) Patent No.: US 12,092,088 B2
(45) Date of Patent: Sep. 17, 2024

(54) POWER END MOUNT PLATE

(71) Applicant: GD Energy Products, LLC, Tulsa, OK (US)

(72) Inventor: Konner Casey Kay, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 14 days.

(21) Appl. No.: 18/096,901

(22) Filed: Jan. 13, 2023

(65) Prior Publication Data

US 2024/0110562 A1 Apr. 4, 2024

Related U.S. Application Data

(63) Continuation-in-part of application No. 17/958,633, filed on Oct. 3, 2022.

(51) Int. Cl.

| | |
|---|---|
| ***F04B 53/22*** | (2006.01) |
| ***F04B 1/00*** | (2020.01) |
| ***F04B 15/02*** | (2006.01) |
| ***F04B 17/05*** | (2006.01) |
| ***F04B 19/22*** | (2006.01) |
| ***F04B 53/16*** | (2006.01) |

(52) U.S. Cl.

CPC ..... *F04B 15/02* (2013.01); *F04B 1/00* (2013.01); *F04B 17/05* (2013.01); *F04B 19/22* (2013.01); *F04B 53/16* (2013.01); *F04B 53/22* (2013.01)

(58) Field of Classification Search

CPC ..... F04B 53/22

See application file for complete search history.

(56) References Cited

U.S. PATENT DOCUMENTS

| | | | | |
|---|---|---|---|---|
| 4,878,815 | A | 11/1989 | Stachowiak | |
| 5,253,987 | A | 10/1993 | Harrison | |
| 6,419,459 | B1 * | 7/2002 | Sibbing | F04B 53/22 417/360 |
| 8,528,462 | B2 | 9/2013 | Pacht | |
| 9,188,123 | B2 | 11/2015 | Hubenschmidt et al. | |
| 9,284,953 | B2 | 3/2016 | Blume | |

(Continued)

FOREIGN PATENT DOCUMENTS

| | | | |
|---|---|---|---|
| WO | 2020123431 | A1 | 6/2020 |
| WO | 2021195572 | A1 | 9/2021 |
| WO | 2021211767 | A1 | 10/2021 |

OTHER PUBLICATIONS

Extended European Search Report for European Patent Application No. 23201038.9 dated Mar. 4, 2024, 7 pages.

*Primary Examiner* — Michael Leslie

(74) *Attorney, Agent, or Firm* — Edell, Shapiro & Finnan, LLC

(57) ABSTRACT

A mount plate for removably connecting a fluid end of a reciprocating pump to a power end for a reciprocating pump includes a first set of openings and a second set of openings, each of which extend through the main body. The first set of openings are configured to receive a first set of couplers that couple the mount plate to a front of the power end. The second set of openings are configured to receive a second set of couplers that couple the mount plate to a fluid end in a spaced relationship. The mount plate may also include a third set of openings that extend through the main body and are configured to receive pony rods of the power end.

20 Claims, 14 Drawing Sheets

(56) References Cited

U.S. PATENT DOCUMENTS

| | | | | |
|---|---|---|---|---|
| 9,745,968 | B2 * | 8/2017 | Kotapish | F04B 53/16 |
| 9,976,544 | B2 | 5/2018 | Morreale | |
| 10,184,470 | B2 | 1/2019 | Barnett | |
| 10,247,184 | B2 | 4/2019 | Chunn et al. | |
| 10,288,178 | B2 | 5/2019 | Nowell et al. | |
| 10,591,070 | B2 | 3/2020 | Nowell et al. | |
| 10,648,490 | B2 | 5/2020 | Foster et al. | |
| 10,670,013 | B2 | 6/2020 | Foster et al. | |
| 10,724,635 | B1 | 7/2020 | Chady | |
| 10,760,567 | B2 | 9/2020 | Salih et al. | |
| 10,781,803 | B2 | 9/2020 | Kumar et al. | |
| 10,895,325 | B2 | 1/2021 | Nowell et al. | |
| 10,907,738 | B2 | 2/2021 | Nowell et al. | |
| 10,941,765 | B2 | 3/2021 | Nowell et al. | |
| 10,941,866 | B2 | 3/2021 | Nowell et al. | |
| 10,962,001 | B2 | 3/2021 | Nowell et al. | |
| 10,989,188 | B2 | 4/2021 | Surjaatmadja et al. | |
| D928,917 | S | 8/2021 | Nowell et al. | |
| 11,078,903 | B2 | 8/2021 | Nowell et al. | |
| 11,105,322 | B2 | 8/2021 | Marica | |
| 11,131,295 | B2 | 9/2021 | Mullins et al. | |
| 11,143,315 | B2 | 10/2021 | Nowell et al. | |
| 11,162,479 | B2 | 11/2021 | Thomas et al. | |
| 11,168,676 | B2 | 11/2021 | Lesko | |
| 11,208,996 | B2 | 12/2021 | Foster et al. | |
| 11,208,997 | B2 | 12/2021 | Chady et al. | |
| 11,268,507 | B2 | 3/2022 | Chady et al. | |
| 11,293,432 | B2 | 4/2022 | Cordes et al. | |
| 11,300,111 | B2 | 4/2022 | Thomas et al. | |
| 11,346,339 | B2 | 5/2022 | Nowell et al. | |
| 11,359,615 | B2 | 6/2022 | Thomas et al. | |
| 11,391,374 | B1 | 7/2022 | Ellisor et al. | |
| 11,421,679 | B1 | 8/2022 | Mullins et al. | |
| 11,434,901 | B2 | 9/2022 | Nowell et al. | |
| 11,454,321 | B2 | 9/2022 | Mullins et al. | |
| 11,708,830 | B2 * | 7/2023 | Nowell | F04B 53/22 417/454 |
| 11,788,527 | B2 * | 10/2023 | Nowell | F04B 53/164 417/571 |
| 2017/0211565 | A1 | 7/2017 | Morreale | |
| 2018/0266573 | A1 | 9/2018 | Nowell et al. | |
| 2019/0120389 | A1 | 4/2019 | Foster et al. | |
| 2019/0178243 | A1 | 6/2019 | Nowell et al. | |
| 2019/0226589 | A1 | 7/2019 | Nowell et al. | |
| 2019/0360483 | A1 | 11/2019 | Nowell et al. | |
| 2019/0368619 | A1 | 12/2019 | Barnett et al. | |
| 2020/0232450 | A9 | 7/2020 | Nowell et al. | |
| 2020/0284253 | A1 | 9/2020 | Foster et al. | |
| 2020/0386221 | A1 | 12/2020 | Pham et al. | |
| 2021/0095650 | A1 | 4/2021 | Nowell et al. | |
| 2021/0108734 | A1 | 4/2021 | Nowell et al. | |
| 2021/0190067 | A1 | 6/2021 | Nowell et al. | |
| 2021/0215154 | A1 | 7/2021 | Nowell et al. | |
| 2021/0270263 | A1 | 9/2021 | Stephens et al. | |
| 2021/0102630 | A1 | 10/2021 | Nowell et al. | |
| 2021/0340978 | A1 | 11/2021 | Graham et al. | |
| 2021/0341079 | A1 | 11/2021 | Thomas et al. | |
| 2021/0348690 | A1 | 11/2021 | Nowell et al. | |
| 2021/0404464 | A1 | 12/2021 | Patoskie | |
| 2021/0404561 | A1 | 12/2021 | Nowell et al. | |
| 2022/0018385 | A1 | 1/2022 | Marica | |
| 2022/0099073 | A1 | 3/2022 | Thomas et al. | |
| 2022/0106951 | A1 | 4/2022 | Foster et al. | |
| 2022/0163033 | A1 | 5/2022 | Myers et al. | |
| 2022/0163034 | A1 | 5/2022 | Foster et al. | |
| 2022/0170580 | A1 | 6/2022 | Stratulate et al. | |
| 2022/0186718 | A1 | 6/2022 | Peer | |
| 2022/0195853 | A1 | 6/2022 | Nowell et al. | |
| 2022/0282719 | A1 | 9/2022 | Barnhouse | |

* cited by examiner

POWER END MOUNT PLATE

CROSS REFERENCE TO RELATED APPLICATIONS

This application is a continuation-in-part of U.S. patent application Ser. No. 17/958,633, filed Oct. 3, 2022, entitled "Power End Mount Plate," the entire disclosure of which is incorporated herein by reference.

FIELD OF INVENTION

The present invention relates to the field of high pressure reciprocating pumps and, in particular, to coupling a fluid end of a high pressure reciprocating pump to a power end of the high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure. Thus, the power end must be securely and stably coupled to the fluid end.

SUMMARY

The present application relates to techniques for mounting a fluid end to a power end. The techniques may be embodied as a mount plate that is provided independent of any other elements, a power end including a mount plate, a fluid end including a mount plate, or a reciprocating pump including a mount plate. Additionally, the techniques may be embodied as a method for coupling one or more fluid ends to a power end of a high pressure reciprocating pump.

More specifically, in accordance with at least one embodiment, the present application is directed to a reciprocating pump including a power end, a fluid end, and a mount plate. The power end is configured to generate pumping power. For example, the power end may include a crankshaft and crosshead assembly that generate pumping power. The fluid end is configured to guide/deliver a fluid from an inlet bore to an outlet bore as the power end drives motion of a reciprocating element. The mount plate is disposed proximate the power end and includes a first set of openings and a second set of openings. The first set of openings is configured to receive a first set of couplers that couple the mount plate to the power end. The second set of openings is configured to receive a second set of couplers that couple the mount plate to the fluid end in a spaced relationship. Among other advantages, the mount plate creates open space between the power end and the fluid end through which a reciprocation bore of the fluid end may be accessed, e.g., to service a removable stuffing box attached to the reciprocation bore.

In some embodiments, the first set of couplers are bolts. Thus, the mount plate can still utilize traditional mounting points on a power end. Additionally or alternatively, the second set of couplers may be tie rods (sometimes referred to as stay rods). The tie rods may extend to and/or through the fluid end and, thus, may support the fluid end and the power end in the spaced relationship. For example, a sleeve of a tie rod may extend between the fluid end and the mount plate to define the spaced relationship.

In some embodiments, the mount plate further comprises a third set of openings configured to receive pony rods of the power end. In many embodiments, each opening of the third set of openings receives a single pony rod; however, the openings of the third set of openings can be connected (e.g., to form a continuous slot) or discrete (e.g., independent openings). Moreover, in at least some instances, the first set of openings are disposed exteriorly of the third set of openings. For example, the first set of openings may surround the third set of openings so that couplers extending through the first set of openings create a structurally sound cage around the third set of openings. Still further, in some instances, the second set of openings are also disposed exteriorly of the first set of openings. Alternatively, the first set of openings may be disposed exteriorly of the second set of openings.

Among other advantages, different arrangements of second openings may allow a single power end to operate with different fluid ends by utilizing different mount plates. That is, the mount plate may enhance the compatibility of a power end so that, for example, a preexisting power end can be used with new fluid ends having new geometries. That said, in yet further embodiments, the fluid end has receivers in a first alignment and the mount plate further comprises a fourth set of openings configured to connect the power end to a second fluid end with receivers in a second alignment. Thus, a single mount plate may allow multiple fluid ends to connect to (and be operational with) a single power end.

Still further, in some instances, the fluid end comprises receivers for the second set of couplers and the receivers comprise through holes that extend from a front of a casing of the fluid end to a back of the casing. Thus, the fluid end may be connected to a power end without tightening connections disposed on a side of a fluid end that is facing the power end (e.g., on a side of the fluid end that houses a reciprocation bore). Additionally or alternatively, the front of the power end may include receivers for the first set of couplers and the receivers may comprise threaded openings. Thus, connections between the mount plate and power end may be completed by threading couplers into the mount plate towards the power end. Moreover, in some embodiments, the fluid end has a removable stuffing box and the spaced relationship between the fluid end and the power end provides access to the stuffing box without decoupling the first set of couplers from the power end or the mount plate and/or without decoupling the second set of couplers from the mount plate or the fluid end. Thus, a stuffing box can be removed and/or serviced quickly and efficiently, minimizing downtime for the pump.

In accordance with another embodiment, the present application is directed to a mount plate for removably connecting a fluid end of a reciprocating pump to a power end for a reciprocating pump. The mount plate includes a main body configured to sit flush against a front of the power end of the reciprocating pump, a first set of openings that extend through the main body, a second set of openings that extend through the main body, and a third set of openings that extend through the main body. The first set of openings are configured to receive a first set of couplers that couple the mount plate to the front of the power end. The second set of openings are configured to receive a second set of couplers that couple the mount plate to a fluid end in a spaced relationship. The third set of openings are configured to receive pony rods of the power end. Among other advantages, the mount plate creates open space between the power end and the fluid end through which a reciprocation bore of the fluid end may be accessed, e.g., to service a removable stuffing box attached to the reciprocation bore.

In some instances, the fluid end to which the second set of couplers connect is a first fluid end, and the mount plate further comprises a fourth set of openings configured to connect the power end to a second fluid end with receivers in a second alignment that is different from a first alignment in which receivers of the first fluid end are aligned. Thus, a single mount plate may allow multiple fluid ends to connect to (and be operational with) a single power end.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a mount plate for a reciprocating pump. The mount plate sits flush against, or at least proximate to, a front of a power end and provides connection points at which different types of fluid ends may be coupled to the power end (with the power end being coupled to one fluid end at any given time). Thus, the size, configuration, and/or types of fluid ends utilized with a specific power end will not be limited by a mounting configuration integrated into a power end. Moreover, with the mount plate presented herein, a coupling between the power end and the fluid end will be spaced apart from the fluid end, creating an elongated cradle through which at least a reciprocation bore (e.g., a plunger bore) of a fluid end may be accessed. Consequently, an end user may be able to service the reciprocation bore and/or service/replace components installed within the reciprocation bore (and/or other bores of a fluid end) without fully disconnecting the fluid end from the power end. This elongated cradle also creates space within which a removable stuffing box and/or other such components can be mounted to the fluid end. Consequently, if the stuffing box and/or components installed in the stuffing box is/are damaged or worn, the stuffing box and/or components can be quickly replaced or repaired, minimizing downtime for the pump.

Figure 1:
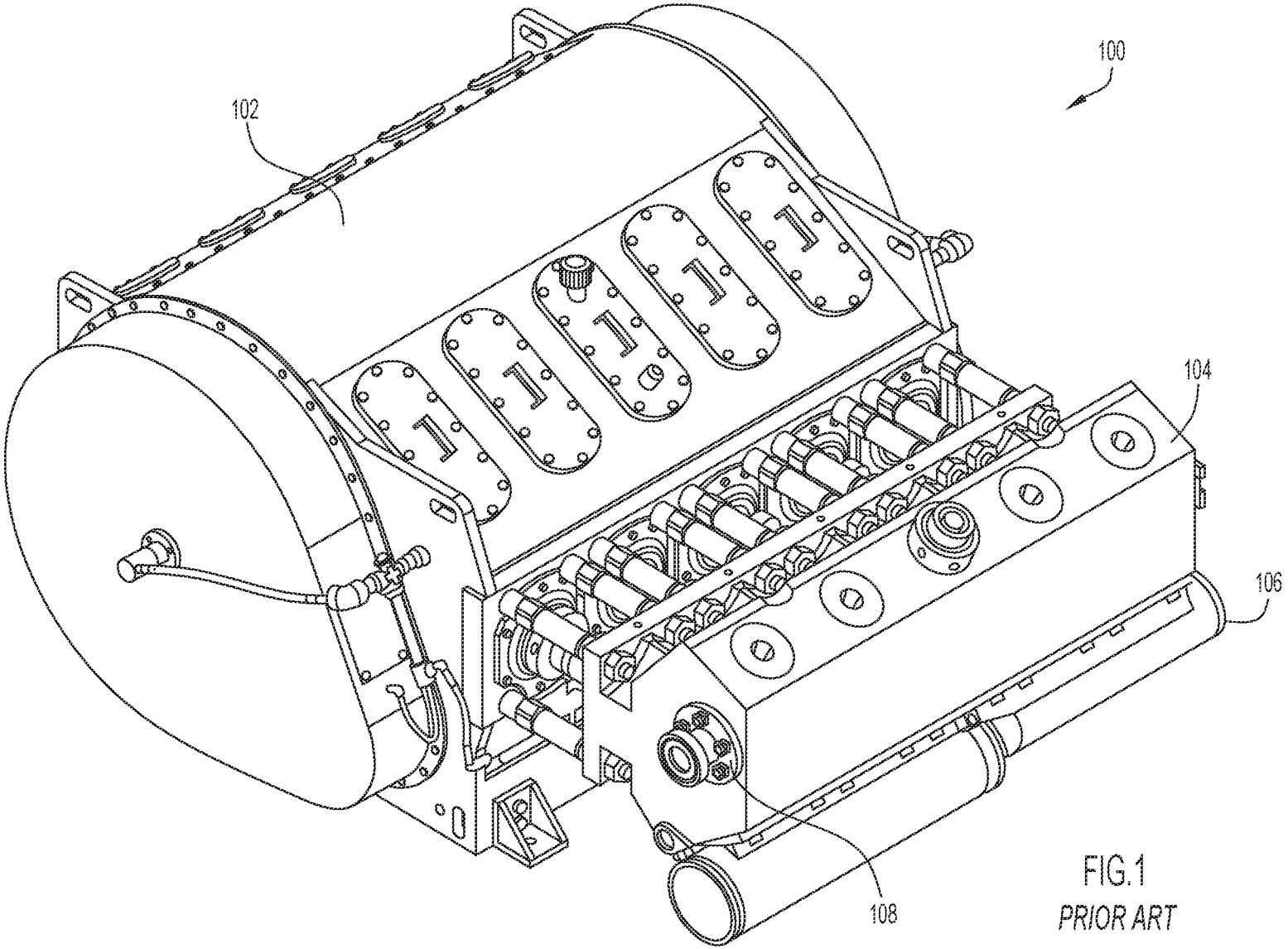
FIG.1 PRIOR ART
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft 103 that drives a plurality of reciprocating plungers or pistons (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for hydraulic fracturing, which may be noted herein where applicable.

In any case, often, the reciprocating pump 100 may be quite large and may, for example, be supported by a semitractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable.

Figure 2A:
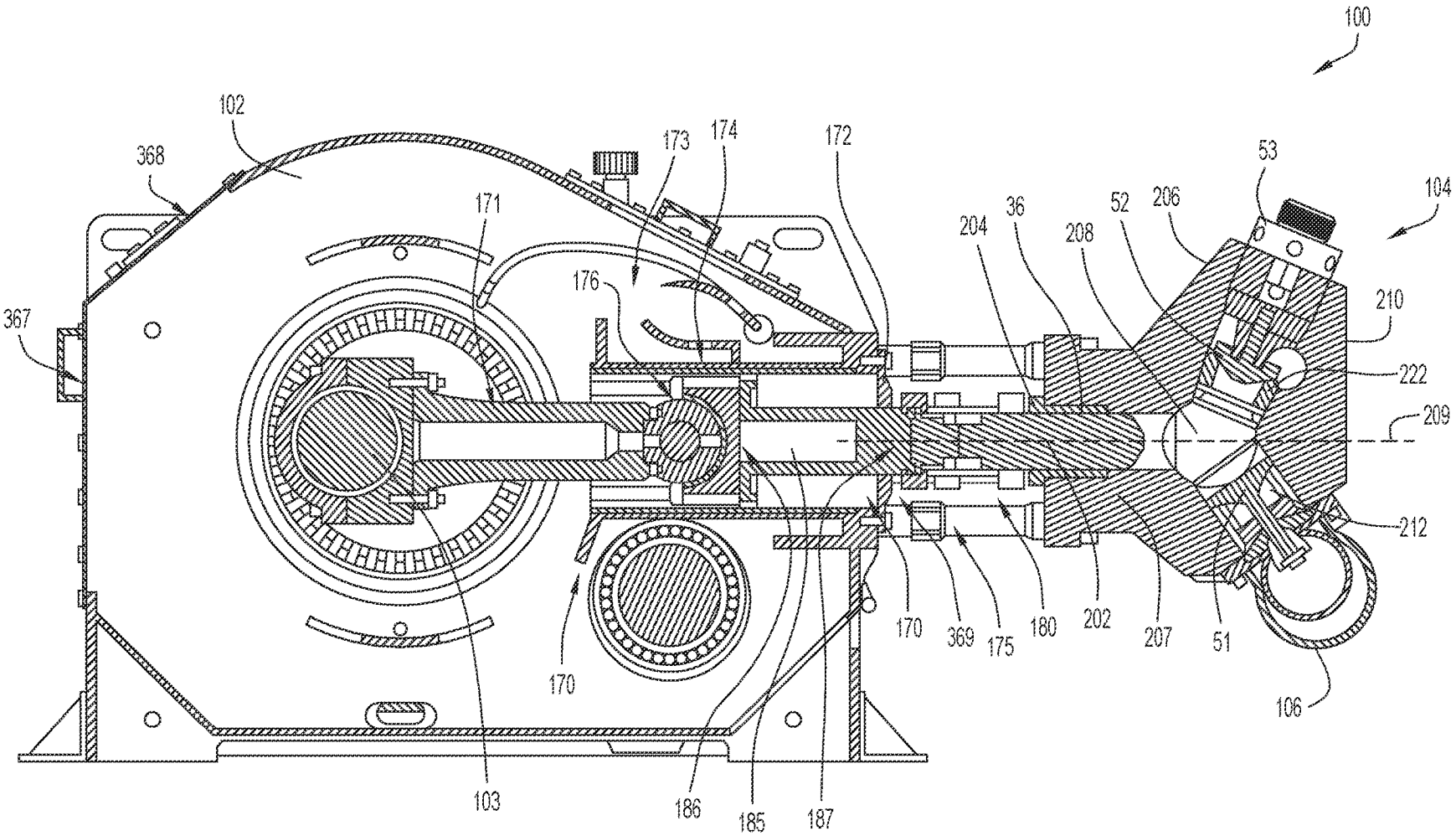
FIG.2A PRIOR ART
FIG. 2A is a side cross-sectional view of the prior art reciprocating pump of FIG. 1.

Still referring to FIG. 1, but now in combination with FIG. 2A, the reciprocating pump 100 pumps fluid into and out of pumping chambers 208. FIG. 2A shows a side, cross-sectional view of reciprocating pump 100 taken along a central axis 209 of one of the reciprocating elements 202 included in reciprocating pump 100. Thus, FIG. 2A depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a reciprocating element 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100, such as the "packing seals" surrounding a reciprocating element 202 of a fracking fluid end, creating a need for continued maintenance.

In various embodiments, the fluid end 104 may be shaped differently and/or have different features, but may still generally perform the same functions, define similar structures, and house similar components. For example, while fluid end 104 includes a first bore 204 that intersects an inlet bore 212 and an outlet bore 222 at skewed angles, other fluid ends may include any number of bores arranged along any desired angle or angles, for example, to intersect bore 204 (and/or an access bore) substantially orthogonally and/or so that two or more bores are substantially coaxial. Generally, bores 212 and 222, as well as any other bores (i.e., segments, conduits, etc.), may intersect to form a pumping chamber 208, may be cylindrical or non-cylindrical, and may define openings at an external surface 210 of the casing 206. Additionally, bores 212 and 222, as well as any other bores (i.e., segments, conduits, etc.), may receive various components or structures, such as sealing assemblies or components thereof.

In the depicted embodiment, inlet bore 212 defines a fluid path through the fluid end 104 that connects the pumping chamber to a piping system 106 delivering fluid to the fluid end 104. Meanwhile, outlet bore 222 allows compressed fluid to exit the fluid end 104. Thus, in operation, bores 212 and 222 may include valve components 51 and 52, respectively, (e.g., one-way valves) that allow bores 212 and 222 to selectively open and deliver a fluid through the fluid end 104. Typically, valve components 51 in the inlet bore 212 may be secured therein by a piping system 106 (see FIG. 1). Meanwhile valve components 52 in outlet bore 222 may be secured therein by a closure assembly 53 that, in the prior art example illustrated in FIG. 2A, is removably coupled to the fluid end 104 via threads.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through pumping chamber 208 (due to reciprocation of a reciprocating elements 202), and then flows through outlet bores 222 into a channel 108 (see FIG. 1). However, piping system 106 and channel 108 are merely example conduits and, in various embodiments, fluid end 104 may receive and discharge fluid via any number of pipes and/or conduits, along pathways of any desirable size or shape.

Meanwhile, each of bores 204 defines, at least in part, a cylinder for reciprocating elements 202, and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36. Reciprocation of a reciprocating element 202 in or adjacent to bore 204, which may be referred to as a reciprocation bore (or, for fracking applications, a plunger bore), draws fluid into the pumping chamber 208 via inlet bore 212 and pumps the fluid out of the pumping chamber 208 via outlet bore 222. However, over time, the packing assembly 36 will wear and/or fail, and thus, must be accessed for maintenance and/or replacement. Other components, such as valve components 51 and/or 52, or the fluid end casing 206 itself may also wear and/or fail and require repair or replacement over time. To help provide access to these parts and/or the pumping chamber, some fluid ends have access bores that are often aligned with (and sometimes coaxial with) the reciprocating bore 204. Other fluid ends needs not include access bore and, thus, such an access bore is not illustrated in FIGS. 1 and 2A.

Regardless of whether the fluid end includes an access bore, the packing assembly 36 typically needs to be replaced from an outer opening of bore 204 (i.e., a side of bore 204 aligned with the external surface 210 of the casing 206). At the same time, to operate properly, the fluid end 104 must be securely and stably coupled to the power end 102. Thus, often, with prior art reciprocating pumps like reciprocating pump 100, the fluid end 104 is directly coupled to the power end 102 with relatively short couplers 175 and at least a portion of the reciprocating pump 100 must be disassembled to access bore 204, e.g., to replace packing assembly 36.

Figure 2B:
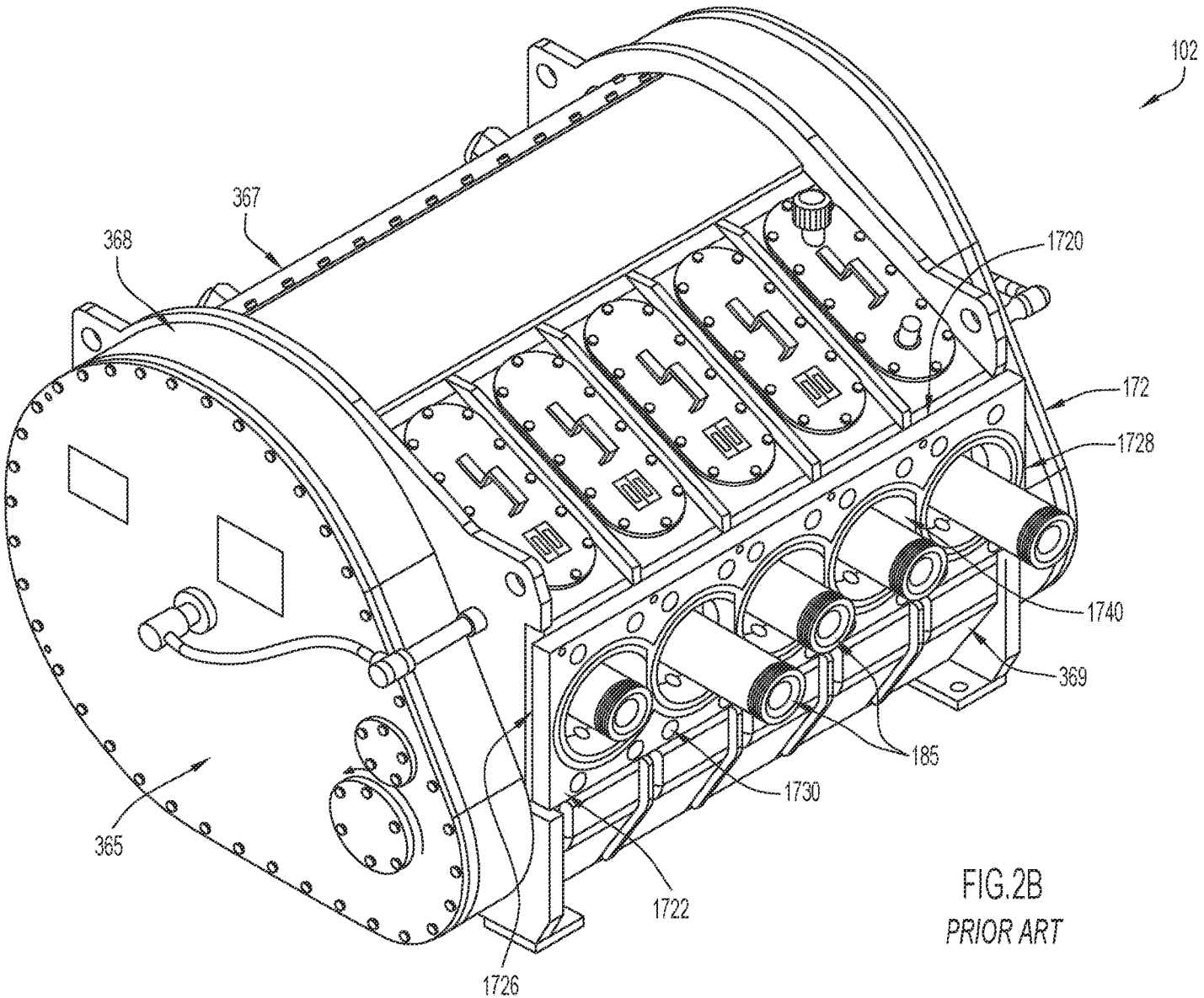
FIG.2B PRIOR ART
FIG. 2B is a front perspective view of the prior art power end of FIG. 1.

Now turning to FIGS. 2A and 2B, in the depicted prior art reciprocating pump 100, couplers 175 (e.g., tie rods, which are sometimes referred to as stay rods) are threaded to a nose plate 172 of a crosshead assembly 170 of the power end 102 to position the fluid end 104 in close proximity to the power end 102. This limits the overall size of the cradle 180 (i.e., the space between the fluid end 104 and the power end 102, in which a plunger or piston may reciprocate), while also limiting the amount of open space available in the cradle 180. Thus, the power end 102 might need to be fully disconnected from the fluid end 104 to create the space needed to service the fluid end 104. But, at the same time, repeatedly connecting and disconnecting the threaded couplers 175 and the nose plate 172 (or from threaded couplers formed on any other fixed or irremovably portion of a power end) may strip the couplers 175 and require replacement of couplers 175.

Moreover, since couplers 175 connect directly to the nose plate 172, the power end 102 may only be able to operate with fluid ends specifically designed to receive couplers 175 in the arrangement dictated by nose plate 172. In the prior art power end 102, this nose plate is welded or otherwise irremovably coupled to a crosshead frame 174 of a crosshead assembly 170 of the power end 102. That is, the nose plate 172 is integrated into or formed with the power end 102. Thus, the power end 102 may only be operable with fluid ends that include coupling features that match the orientation of coupling features included on nose plate 172. At the same time, the position of the nose plate 172 is not adjustable or manipulable because the irremovable connection/integration of the nose plate 172 into the power end 102 allows the nose plate 172 to withstand extremely high stresses imparted thereto during generation of pumping power by the power end 102. That said, in other prior art power ends, couplers 175 might connect directly into another part of portion of a power end that is able to withstand these high stresses (e.g., into a frame portion), but these coupling points are typically fixed on and/or irremovable from the power end 102. Either way, a power end 102 that directly receives couplers connecting the power end 102 to a fluid end 104 may have limited compatibility across different fluid ends.

More specifically, with the prior art power end 102, the locations at which a fluid end 104 may be coupled to the power end 102 are fixed and/or preset by a set of receptacles 1730. In this particular prior art power end 102 the nose plate 172 defines the locations of receptacles 1730 for the power end 102 (which is positioned at and/or generally defines a front of the power end 102). However, in other embodiments, receptacles 1730 could be included in any part or portion of a power end. That is, the power end 102 may include a frame 368 that extends from a front 369 to a back 367 and the receptacles 1730 may generally be included in the front 369 of frame 368. Receptacles 1730 can be seen clearly in FIG. 2B, which shows the power end 102 disconnected from the fluid end 104, e.g., during maintenance of the packing assembly 36 included in the fluid end 104. FIG. 2B also clearly shows how, in this particular embodiment, the nose plate 172 extends from a first end 1726 to a second end 1728 and also extends from a back surface 1720 to a front surface 1722.

Generally, in prior art power ends that include a nose plate 172, the nose plate 172 is installed or formed in the power end 102 by forming the nose plate 172 with the frame 368, irremovably welding the nose plate 172 to the frame 368, or otherwise irremovably coupling the nose plate 172 to the frame 368. Once installed, the first end 1726 of the nose plate 172 is positioned proximate a first side 365 of the frame 368 of the power end 102 (e.g., aligned with a housing for a main roller and pinion) and the second end 1728 of the nose plate 172 is positioned proximate a second side 366 (see, e.g., FIG. 4) of the frame 368 (e.g., aligned with a housing for a main roller and pinion). Meanwhile, the back surface 1720 of the nose plate 172 faces and/or defines the front 369 of frame 368. In fact, in some instances, the nose plate 172 encloses a crosshead frame 174 of the crosshead assembly 170 (but does not necessarily do so in all power ends, e.g., see FIG. 15).

In the depicted embodiment, the receptacles 1730 extend into the nose plate 172 from the front surface 1722 and are generally disposed around pony rod holes 1740. However, in other embodiments, the receptacles 1730 need not be positioned as such (e.g., see FIG. 15). In any case, the receptacles 1730 may be threaded so that a threaded coupler 175 can be secured directly therein. Still further, in some instances, receptacles 1730 need not extend through back surface 1720, which may prevent couplers 175 from extending into the crosshead assembly 170 and interfering with operations of the crosshead assembly 170 and/or allowing contaminants into the crosshead assembly 170. However, other embodiments might include receptacles 1730 that are through holes.

Still referring to FIGS. 2A and 2B, in the prior art reciprocating pump 100—and in most high pressure reciprocating pumps—the crosshead frame 174 is a part of a crosshead assembly 170 that converts rotational motion of the crankshaft 103 into linear, reciprocating motion of a pony rod 185. More specifically, the crosshead assembly 170 includes a connecting rod 171, a crosshead 173, and a pony rod 185. The crosshead 173 includes a connector 176 disposed within a crosshead frame 174 and the connecting rod 171 extends from the crankshaft 103 to the connector 176. The connector 176 is configured to move linearly within the crosshead frame 174 and opposite ends of the connecting rod 171 are configured to travel with the crankshaft 103 and the connector 176.

Thus, as the connecting rod 171 rotates with the crankshaft 103, it reciprocates the connector 176 within the crosshead frame 174. The connector 176 is also connected to a back side 186 of the pony rod 185 so that the pony rod 185 reciprocates with the connector 176. Meanwhile, a front side 187 of the pony rod 185 can be coupled to a reciprocating element 202 (e.g., a plunger), such as via a clamp 495 (see FIG. 5A), to drive reciprocating motion of the reciprocating element 202 that pumps fluid through the fluid end 104. Notably, during this action, the pony rod 185 and/or the crosshead 173 exert forces on the front 369 of the frame 368, which in the specific embodiment depicted in FIGS. 2A and 2B, is defined, at least in part, by nose plate 172. These forces stress the frame 368 and/or the nose plate 172 (and potentially the crosshead frame 174). Thus, as mentioned, in embodiments where a nose plate 172 defines at least a portion of the front 369 of a frame 368, the nose plate 172 is usually irremovably coupled to the crosshead frame 174 to remain structurally sound during operation of the reciprocating pump 100. Additionally or alternatively, a front 369 of frame 368 may be irremovably coupled to other portions of an overall frame for the power end 102.

Figure 3:
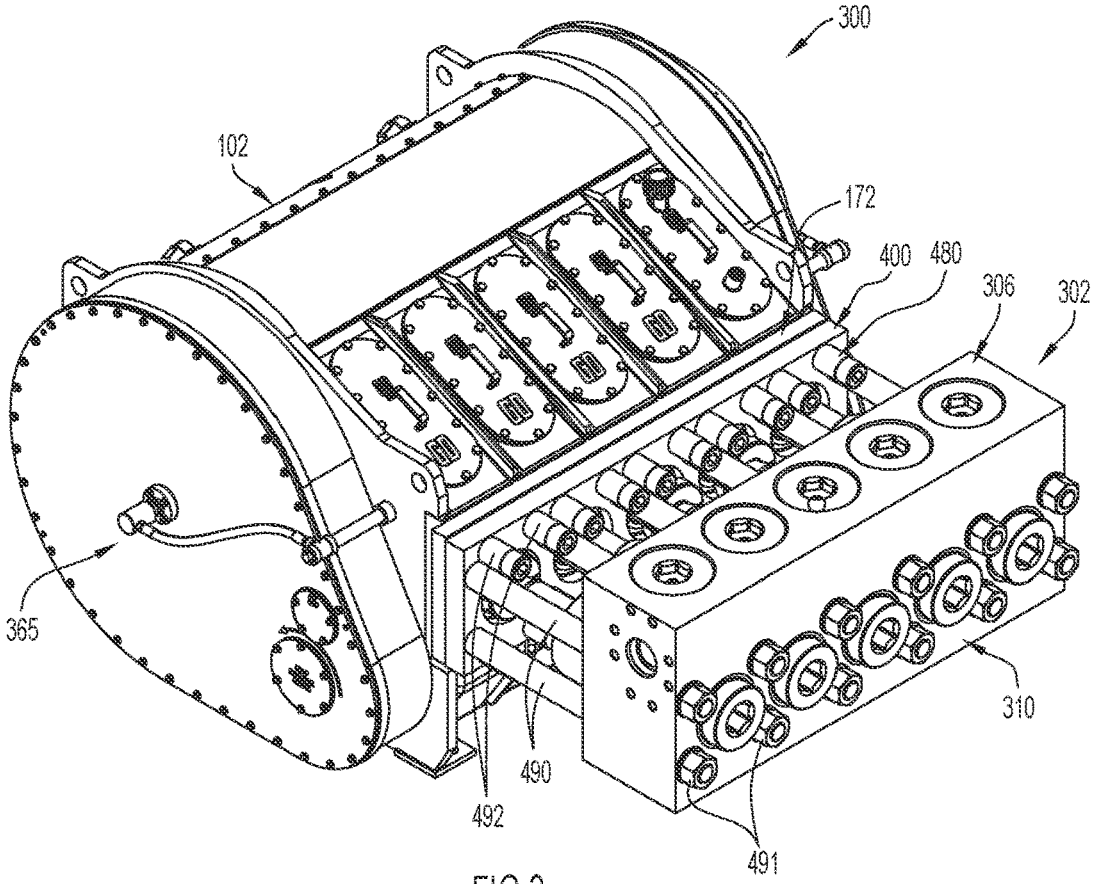
FIG. 3 is a front perspective view of a reciprocating pump including a mount plate coupling a power end to a fluid end, according to an example embodiment of the present application.
Figure 4:
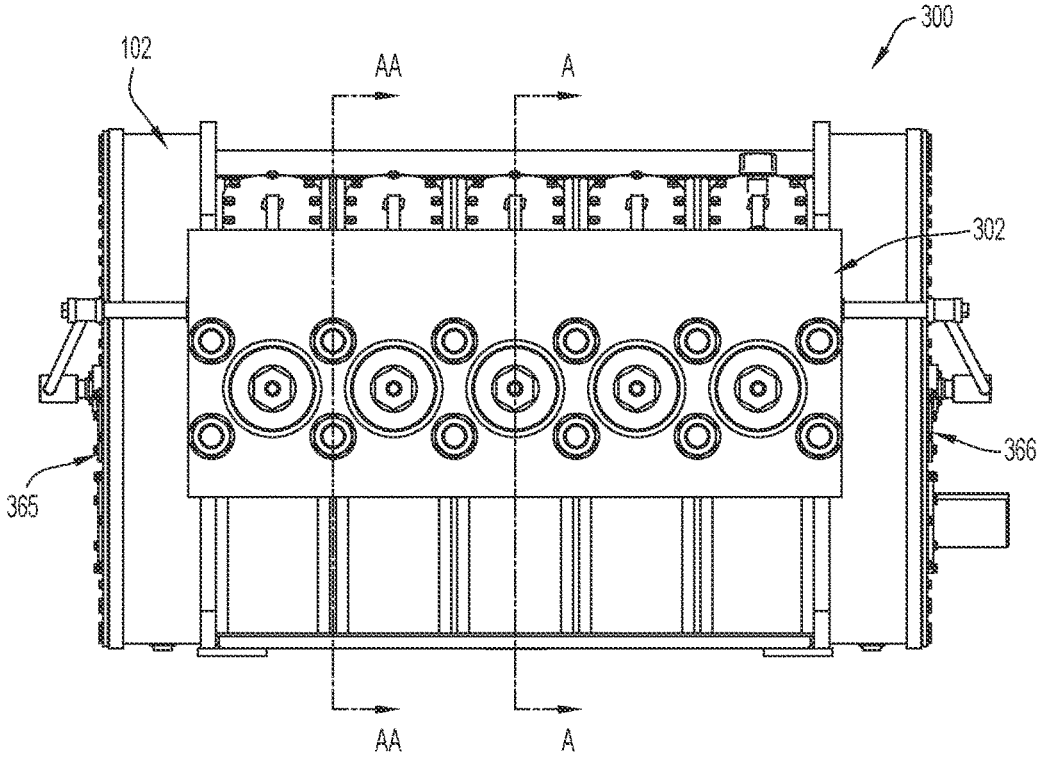
FIG. 4 is a front view of the reciprocating pump illustrated in FIG. 3.
Figure 5A:
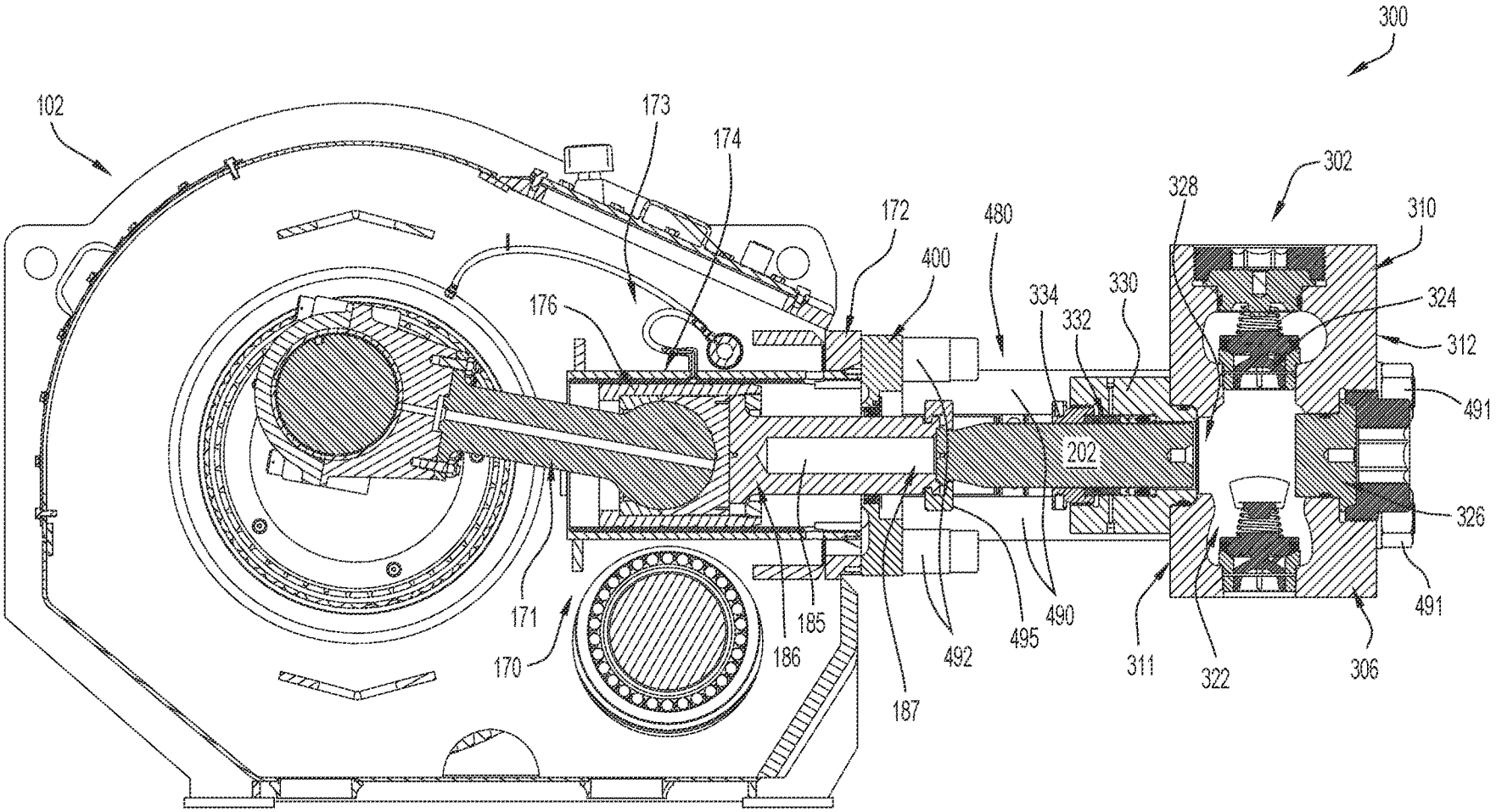
FIG. 5A is a side cross-sectional view of the reciprocating pump illustrated in FIGS. 3 and 4 taken along line "A-A" of FIG. 4.

Now turning to FIGS. 3, 4, and 5A, the present application improves the compatibility and serviceability of a reciprocating pump 300 by coupling a fluid end 302 to the front 369 of the power end 102 via a mount plate 400. FIGS. 3, 4, and 5A depict perspective, front, and sectional views, respectively, of reciprocating pump 300. Notably, in these embodiments, as well as other embodiments of the present application, the mount plate 400 is depicted with the prior art power end 102. This is not intended to be limiting in any way; instead, the power end 102 is one example power end with which the mount plate 400 may be used. In fact, if anything, mount plate 400 is illustrated with power end 102 to illustrate how mount plate 400 may expand the compatibility of prior art power ends. That said, it should be also understood that the techniques presented herein may be embodied as a new power end that includes mount plate 400.

In the depicted embodiment, the mount plate 400 is positioned adjacent (i.e., abutting) the front 369 of frame 368; however, in other embodiments, the mount plate 400 may be positioned proximate the front 369 of frame 368 with some space therebetween (e.g., six inches or less). In either case, the mount plate 400 expands the options for connecting the fluid end 302 to the power end 102. Additionally, the mount plate 400 allows for expansion of the cradle 480, both longitudinally (i.e., the direction between the power end 102 and the fluid end 302), laterally (i.e., a direction that extends parallel to a distance between sides 365 and 366 of the power end 102), and/or radially (i.e., both laterally and in a height direction that extends in a plane perpendicular to the longitudinal and lateral directions). This is because a first set of couplers 492 extend through the mount plate 400 in a first direction (towards the power end 102) to couple the mount plate 400 to the front 369 of frame 368 (e.g., via nose plate 172) while a second set of couplers 490 extend through the mount plate 400 in a second direction to couple the mount plate 400 to fluid ends. Thus, while the first set of couplers 492 needs to be positioned to match a configuration of the receptacles 1730 included on the front 369 of frame 368 (e.g., on the nose plate 172, see, e.g., FIG. 2B), the second set of couplers 490 are free to be positioned in any desired configuration or location, for example, to allow the power end 102 to be connected to fluid end 302 and/or any other desirable fluid end.

In fact, with the mount plate 400, the cradle 480 may be large enough and/or provide enough space (e.g., between couplers 490) that a reciprocation bore 328 of fluid end 302 can be serviced without fully disconnecting the fluid end 302 from the power end 102. Instead, the fluid end 302 might be only partially disconnected from the power end 102. For example, a reciprocation element 202 could be disconnected from the front side 187 of a pony rod 185, and the reciprocation bore 328 and/or components installed therein/thereon could be serviced or replaced without any further disassembly of the fluid end 302 or power end 102. As a specific example, the size and/or open space of the cradle 480 may enable the fluid end 302 to utilize a removable stuffing box 330 that is serviceable and/or replaceable without fully disconnecting the fluid end 302 from the power end 102.

At least part of the reason that the cradle 480 is expanded is because the number of couplers 490 extending between the mount plate 400 and fluid end 302 can be reduced as compared to prior art arrangements that utilize couplers (e.g., tie rods) to couple a fluid end 302 directly to the power end 102 (e.g., via casing 306). With the mount plate 400, the size of the couplers is not restricted by the power end 102 (e.g., by the receptacles 1730 of nose plate 172). Thus, the couplers can have a larger diameter and a fewer number of couplers 490 can support the full load of forces transmitted between the fluid end 302 and the power end 102, e.g., as compared to a diameter of couplers (e.g., tie rods) used in prior art arrangements to couple a fluid end 302 directly to the power end 102. When the number of couplers 490 extending from the fluid end 302 is reduced, the open space in cradle 480 increases (e.g., as compared to prior art arrangements that utilize couplers (e.g., tie rods) to couple a fluid end 302 directly to the power end 102). Additionally, when couplers 490 have a larger diameter, the couplers 490 may be stronger and the length of the couplers 490 can be increased to increase the longitudinal dimension of cradle 480 (e.g., as compared to prior art arrangements that utilize couplers (e.g., tie rods) to couple a fluid end 302 directly to the power end 102).

Still further, if the fluid end 302 needs to be disconnected from the power end 102, e.g., for complex servicing and/or repair, the mount plate 400 may enable the fluid end 302 to be disconnected from the power end 102 without removing couplers from the front 369 of frame 368 (e.g., from nose plate 172). For example, couplers 490 could be decoupled from mount plate 400 while mount plate 400 remains mounted to the front 369 of frame 368 (e.g., to nose plate 172) with couplers 492. Then, the fluid end 302 would be disconnected from the power end 102 without risk of stripping the couplers 492 or the receptacles 1730. As mentioned, replacing or repairing the front 369 of frame 368, such as nose plate 172 (e.g., by repairing a stripped receptacle 1730), is often extremely difficult (if not impossible). Thus, the mount plate 400 may avoid significant downtime that is incurred when a receptacle 1730 is stripped by repeatedly installation and removal of a threaded coupler. Additionally or alternatively, the mount plate 400 may allow an end user to avoid temporarily or permanently replacing a power end 102 when the front 369 of frame 368 (e.g., nose plate 172) is damaged (since the mount plate 400 allows the front 369 of frame 368, such as nose plate 172, to remain untouched when decoupling a fluid end from power end 102).

Figure 5B:
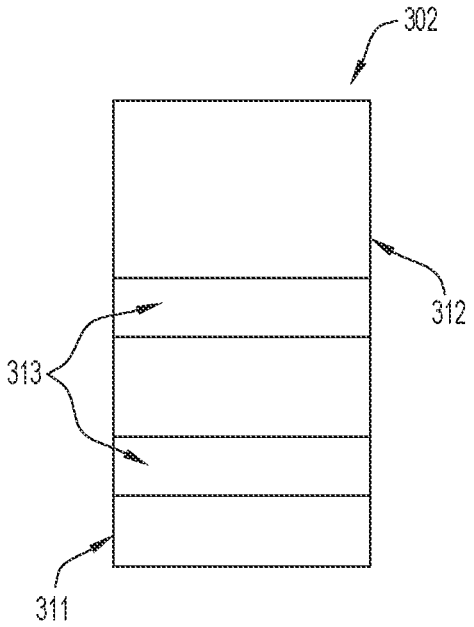
FIG. 5B is a side cross-sectional view of the fluid end illustrated in FIGS. 3, 4, and 5A taken along line "AA-AA" of FIG. 4.

Now turning to FIGS. 5A and 5B, which are sectional views of reciprocating pump 300 and fluid end 302, respectively, in the depicted embodiment the mount plate 400 mounts a flangeless fluid end casing 306 to power end 102. As mentioned, this fluid end casing 306 can receive a removable stuffing box 330 in or on its reciprocation bore 328. This reciprocation bore 328 extends perpendicular to an inlet bore 322 and an outlet bore 324 and is substantially coaxial with an access bore 326. Each of these bores extends from an external surface 310 of a casing 306 to a cross-bore or pumping chamber, with the reciprocation bore 328 extending to a front side 311 of the casing 306 and the access bore 326 extending to a back side 312 of the casing 306. Meanwhile, the inlet bore 322 and an outlet bore 324 may extend substantially vertically and house valve components that allow fluid to selectively flow through the fluid end 302. However, the shape, orientation, alignment, etc. of the external surface 310 of and bores 322, 324, 326, and 328 are merely examples and, in other embodiments, the fluid end may include any desirable features, components, shaping, alignment, etc. In fact, any description of fluid end 104 included above should be understood to apply to like and/or similar parts of fluid end 302 and/or casing 306.

Notably, since the fluid end 302 includes a removable stuffing box 330, the casing 306 can be smaller and the exterior surface 310 can be substantially cuboidal. This may reduce the cost of materials needed to form the casing 306 and/or reduce the costs of manufacturing the casing 306. For example, the casing 306 need not require a large forging and careful machining to form a flange that is coupleable to a power end 102, which is a timely and expensive operation. By comparison, many prior art fluid ends include a flange that provides a connection point at which the fluid end can be directly coupled to a power end. The mount plate presented herein allows this flange and the associated machine time to be eliminated, if desired.

Nevertheless, fluid end 302 has been depicted as an example fluid end at least because it is configured to receive a removable stuffing box 330. The removable stuffing box 330 can be coupled to the casing 306 with couplers (e.g., bolts), threads, and/or any other retaining techniques; and, in any case, may entirely support packing seals 332 so that removing the removable stuffing box 330 from the fluid end casing 306 removes the packing seals 332 from the fluid end 302, e.g., for replacement or repair. In the depicted embodiment, the packing seals 332 are retained in the removable stuffing box 330 by a retaining ring 334 that is threaded into the removable stuffing box 330; however, in other embodiments, the packing seals 332 might be retained in the removable stuffing box 330 in any desirable manner. In any case, when the removable stuffing box 330 is removable from the fluid end casing 306, the removable stuffing box 330 can be positioned between couplers 490 (e.g., radially—in lateral and height dimensions) so that the removable stuffing box 330 can be disconnected from the fluid end casing 306 and moved longitudinally away from the front side 311 of the fluid end casing 306 (e.g., towards a front of the power end 102) without fully disconnecting the fluid end 302 from the power end 102.

More specifically, when the removable stuffing box 330 is positioned between couplers 490, the removable stuffing box 330 can be moved longitudinally away from the front side 311 of the fluid end casing 306 (e.g., towards the power end 102). During this movement, the removable stuffing box 330 will not encounter obstacles in the cradle 480 because the couplers 490 substantially surround the removable stuffing box 330. In fact, in at least some embodiments, the couplers 490 may create a structurally sound cage around the third set of openings and this cage may be large enough that a removable stuffing box 330 (including components coupled thereto or installed therein, such as packing seals 332 and/or retaining ring 334) can be maneuvered therein, at least along a longitudinal direction.

In some instances, the reciprocating element 202 can be disconnected from a pony rod 185 and temporarily removed from the reciprocating pump 300 prior to maneuvering a removable stuffing box 330 in the cradle 480. Alternatively, the removable stuffing box 330 might be slid along reciprocating element 202 to maneuver the removable stuffing box 330 in the cradle 480 (i.e., in spaced between couplers 490). Either way, when the packing seals 332 are fully supported by a removable stuffing box 330, specific geometries of a fluid end bore (e.g., reciprocation bore 328) need not support the packing seals and an end user will not need to carefully monitor and/or repair the fluid end with expensive and timely maintenance operations (e.g., weld repairs). This will also reduce downtime—an end user can replace the removable stuffing box 330 much faster than an end user can repair a washed out fluid end bore. Moreover, if the packing seals 332 are fully supported by a removable stuffing box 330, wear created from debris and fluid contacting a seal location will likely concentrate on the removable stuffing box 330 instead of the fluid end casing 306, eliminating, or at least reducing, the likelihood that the fluid end bore experiences wear and/or washes out.

That all said, other embodiments of removable stuffing box 330 may still realize the above advantages even if the removable stuffing box 330 does not fully support (i.e., encapsulate) the packing seals 332. For example, if the removable stuffing box 330 encloses packing seals 332 in the reciprocation bore 328, disconnecting the removable stuffing box 330 from the fluid end casing 306 without fully disconnecting the fluid end 302 from the power end 102 may allow an end user to quickly and easily access the packing seals 332. Additionally or alternatively, removing the removable stuffing box 330 from the fluid end casing 306 without fully disconnecting the fluid end 302 from the power end 102 may allow an end user to access interior portions of the fluid end casing 306 and/or components disposed in other bores (e.g., in addition to or instead of reciprocation bore 328). Put simply, since the mount plate 400 allows couplers 490 to create an extended and relatively open cradle 480, an end user can quickly access and service or replace a fluid end 302 because the fluid end 302 need not be fully disconnected from the power end 102.

Figure 5C:
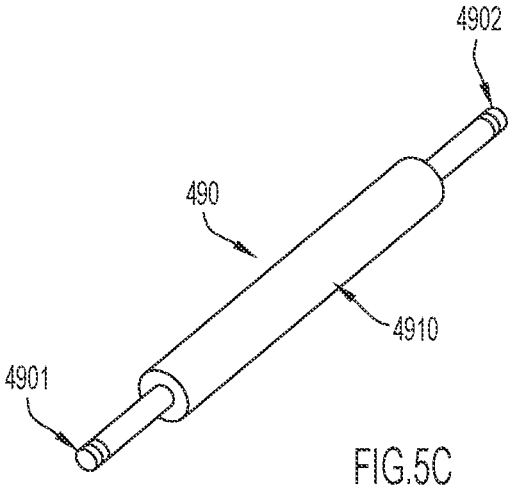
FIG. 5C is a side perspective view of a coupler included in the reciprocating pump illustrated in FIGS. 3, 4, and 5A.

Still referring to FIG. 5A, but now in combination with FIGS. 5B and 5C, in the depicted embodiment, the couplers 490 couple the mount plate 400 to the fluid end 302 by extending entirely through the fluid end casing 306, from the front side 311 of the fluid end casing 306 to the back side 312 of the fluid end casing 306. To realize this, the fluid end casing 306 includes through holes 313 disposed laterally between sets of intersecting bores (e.g., between sets of bores 322, 324, 326, and 328). Then, nuts 491 can be installed on distal ends 4902 of couplers 490 to secure the fluid end casing 306 against the couplers 490. In at least some embodiments, the couplers 490 also include enlarged diameter section 4910, which may be formed by a sleeve (and, thus section 4910 may also be referred to as sleeve 4910) extending between the mount plate 400 and the front side 311 of the fluid end casing 306 to preset a longitudinal dimension of cradle 480. For example, couplers 490 may be tie rods with threaded ends 4901 and 4902 (these threads are illustrated in FIG. 5C, but are only an example option). With the embodiment depicted in FIG. 5C, the first threaded end 4901 may thread into a first opening in the mount plate 400 while the second threaded end 4902 receives nuts 491 on the back side 312 of the fluid end casing 306.

In any case, when the couplers 490 extend through holes 313, the connection between the mount plate 400 and the fluid end 302 can be tightened (e.g., via nuts 491) on the back side back side 312 of the fluid end casing 306, which is often less obstructed and easier to access than the front side 311 of the fluid end casing 306. That is, when the couplers 490 extend through holes 313, the fluid end 302 may be connected to a power end 102 without tightening connections disposed on the front side 311 of fluid end casing 306. This may make installation easier and quicker as compared to arrangements that require torquing in tight locations on the front side 311 of a fluid end casing 306.

Figure 6A:
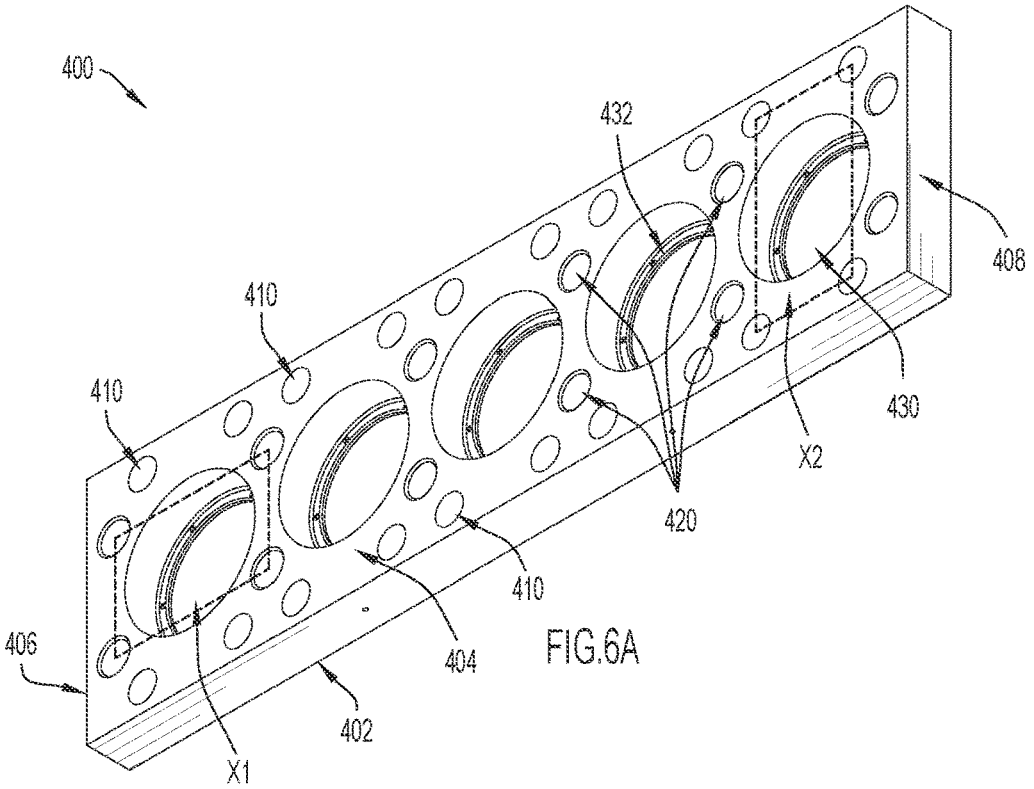
FIG. 6A is a front perspective view of the mount plate included in the reciprocating pump of FIGS. 3, 4, 5A, and 5B.
Figure 6B:
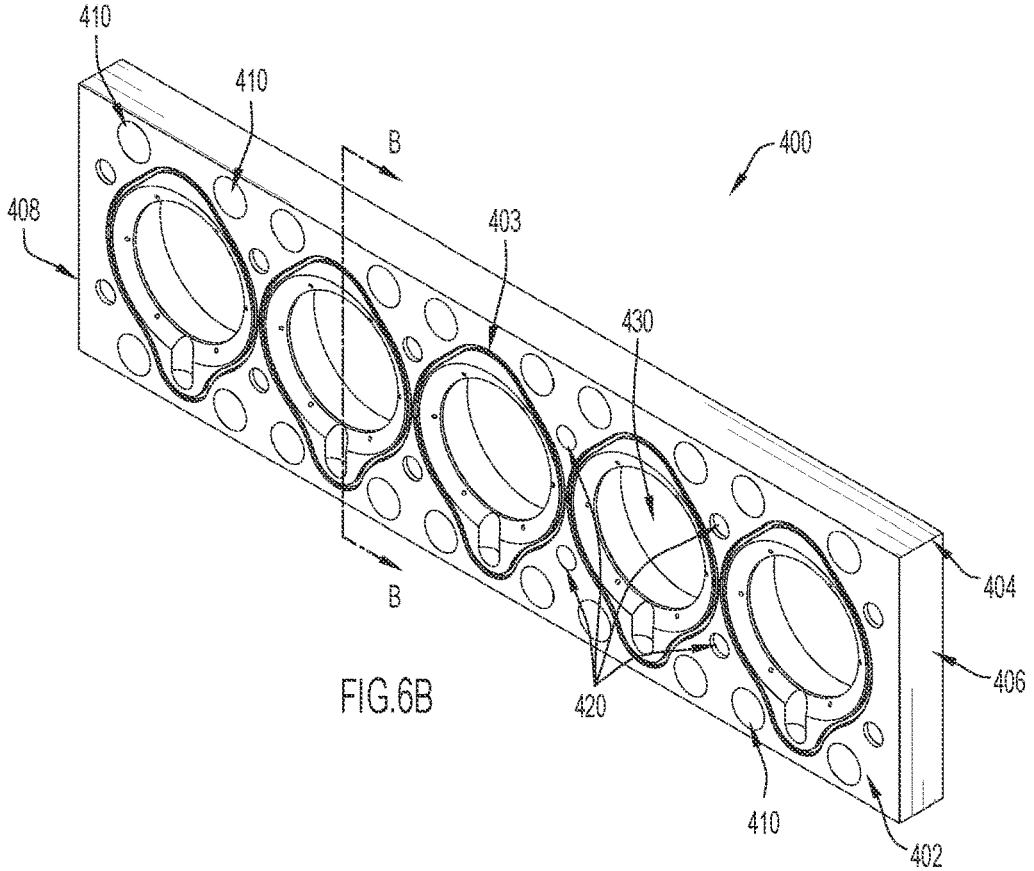
FIG. 6B is a rear perspective view of the mount plate of FIG. 6A.

Now turning to FIGS. 6A and 6B, which depicts mount plate 400 independent of reciprocating pump 300, as mentioned, the mount plate 400 includes at least a first set of openings 410 and a second set of openings 420. The first set of openings 410 are configured to receive a first set of couplers 492, e.g., bolts, which couple the mount plate 400 to the power end 102 of the power end 102. The second set of openings 420 is configured to receive a second set of couplers 490, e.g., tie rods, which couple the mount plate 400 to the fluid end 302 in a spaced relationship (e.g., with the spacing defined by a sleeve, such as sleeve 4910). In some embodiments, both the first set of openings 410 and the second set of openings 420 extend through the mount plate 400, from a front surface 404 of a main body of the mount plate 400 to a back surface 402 of the main body of the mount plate 400. However, in other embodiments, the first set of openings 410 and/or the second set of openings 420 need not be through holes. For example, openings 410 might be accessible from only the front surface 404 of the mount plate 400 (e.g., if couplers 490 thread into the front surface 404) and/or openings 420 might be accessible from only the back surface 402 of the mount plate 400 (e.g., if couplers 492 thread into the back surface 402).

Generally, openings 410 and openings 420 may be sized to receive their respective couplers. Thus, in some embodiments, openings 410 are larger than openings 420, but in other embodiments the opposite may be true. Alternatively, openings 410 and/or openings 420 need not be constantly sized and can vary with respect to other openings of their set or with respect to openings of other sets. In the embodiment of FIGS. 3, 4, 5A, 5B, and 6A, openings 420 are generally larger than openings 410 and the openings 420 are positioned interiorly of openings 410 (or, from another perspective, openings 410 are positioned exteriorly of openings 420). Thus, the couplers 492 (e.g., bolts) are not positioned within an enclosure (e.g., cage) generally defined by couplers 490 (e.g., tie rods) and do not decrease an amount of space "X1" provided between couplers 490 (an example of which is generally depicted with a dashed line in FIG. 6A).

In at least some embodiments, this space X1 is larger than an outer dimension of a removable stuffing box 330 so that a removable stuffing box 330 can be removed in a longitudinal direction through a three-dimensional space with a cross-section defined by space X1. In fact, in some embodiments, the distance between two adjacent openings 420 may be larger than an outer dimension of a removable stuffing box 330 so that a removable stuffing box 330 can be entirely removed from the cradle 480 without removing couplers 490. However, the distance between all adjacent openings 420 need not be larger than an outer dimension of a removable stuffing box 330—one or more pairs of adjacent openings 420 can be separated by such a distance. Meanwhile, openings 410 may be generally aligned at corners of space X2 so that the couplers 492 align with receptacles 1730 included on the front 369 of frame 368.

Also, in any case, openings 410 and openings 420 may both generally surround a third set of openings 430 that are each configured to receive at least a pony rod 185 and/or a reciprocating element 202 (e.g., depending on the position of a stroke and/or the specific lengths/arrangements of these elements). When openings 410 and openings 420 both generally surround the third set of openings 430, couplers 490 and couplers 492 may each stably support each pony rod 185 and/or reciprocating element 202. That is, openings 420 may be positioned so that couplers 490 create a structurally sound cage around the third set of openings 430 and/or openings 410 may be positioned so that couplers 492 create a structurally sound connection to the power end 102 around each opening of the third set of openings 430.

In the depicted embodiment, the back surface 402 of the mount plate 400 defines grooves 403 that each surround one of the openings 430. Additionally, each of the openings 430 includes an interior lip 432. The groove 403 may receive a sealing element (e.g., an O-ring) that forms an exterior seal around each opening 430 (e.g., when the mount plate 400 is secured in a position abutting a power end 102); however, the groove 403 need not be included in all embodiments. Moreover, embodiments including a groove 403 can include a groove of any size or shape, with any relief or installation features now known or developed hereafter. Meanwhile, the interior lip 432 provides a location on which at least a portion of an oil stop assembly 450 may be mounted. One example oil stop assembly 450 is generally shown in FIG. 5A and is described in further detail below in connection with FIGS. 6C-6E, which depict the oil stop assembly 450 in further detail. Generally, the oil stop assembly 450 may engage and seal a pony rod 185 and/or a crosshead frame 174 serve to retain oil in the crosshead assembly 170 of the power end 102.

Still referring to FIGS. 6A and 6B, the mount plate 400 also extends from a first end 406 to a second end 408. In the depicted embodiment, the first end 406 is generally aligned with the first end 1726 of the nose plate 172 and the second end 408 is generally aligned with the second end 1728 of the nose plate 172. That is, in the depicted embodiment, the mount plate 400 laterally spans the nose plate 172. However, in other embodiments, the mount plate 400 can span any portion of the front 369 of frame 368 and/or extend beyond the lateral ends of the front 369 of frame 368 (e.g., as defined by sides 365 and 366), which may or may not include nose plate 172. Additionally or alternatively, the mount plate 400 can be modular and can include sub-plates that collectively span any portion of the front 369 of frame 368 and/or collectively extend beyond the lateral ends of the front 369 of frame 368 (e.g., as defined by sides 365 and 366). Meanwhile, the mount plate 400 may extend longitudinally so that the mount plate 400 spans any portion of the front 369 of frame 368 (e.g., any portion of nose plate 172) and/or extends beyond the longitudinal ends of the front 369 of frame 368 (e.g., the longitudinal ends of nose plate 172).

Figure 6C:
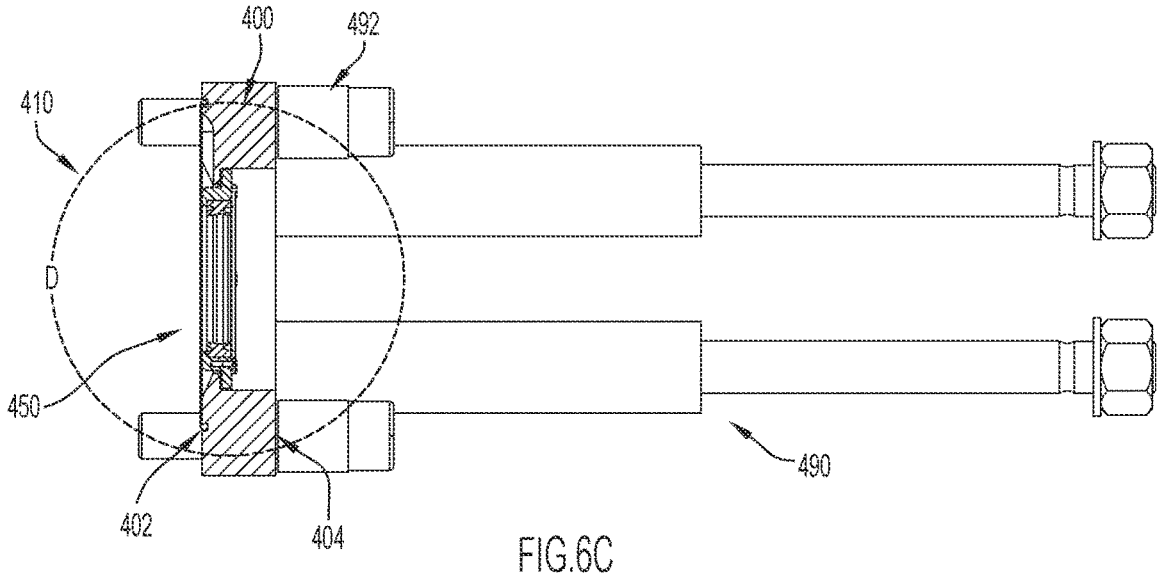
FIG. 6C is a sectional view of the mount plate of FIGS. 6A and 6B taken along line "B-B" of FIG. 6B, while the couplers and an oil stop assembly of FIG. 5A are connected thereto.
Figure 6D:
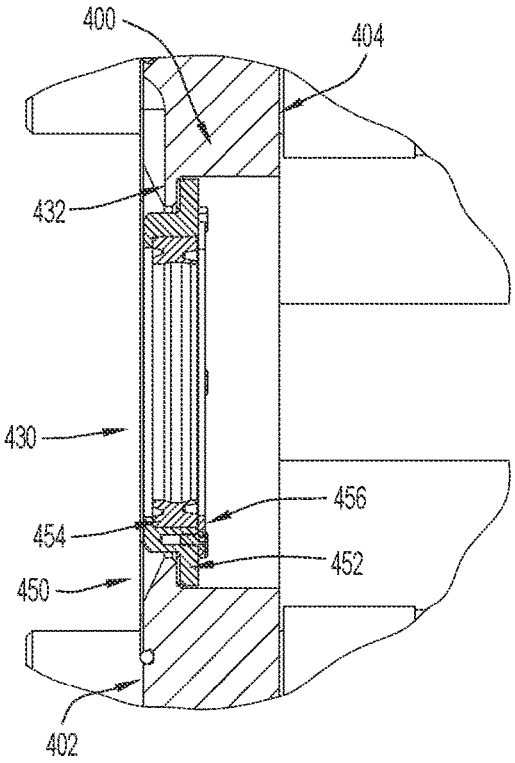
FIG. 6D is a detail view of detail area "D" of FIG. 6C.
Figure 6E:
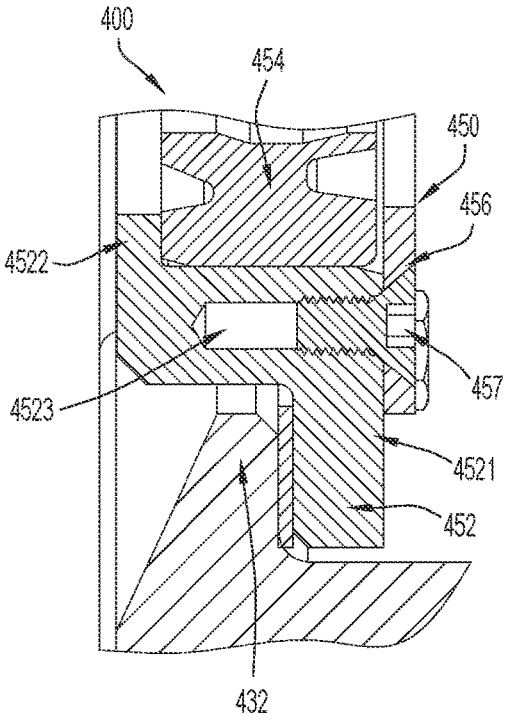
FIG. 6E is a detail view of a portion of the oil stop assembly depicted in FIG. 6D.
Figure 7:
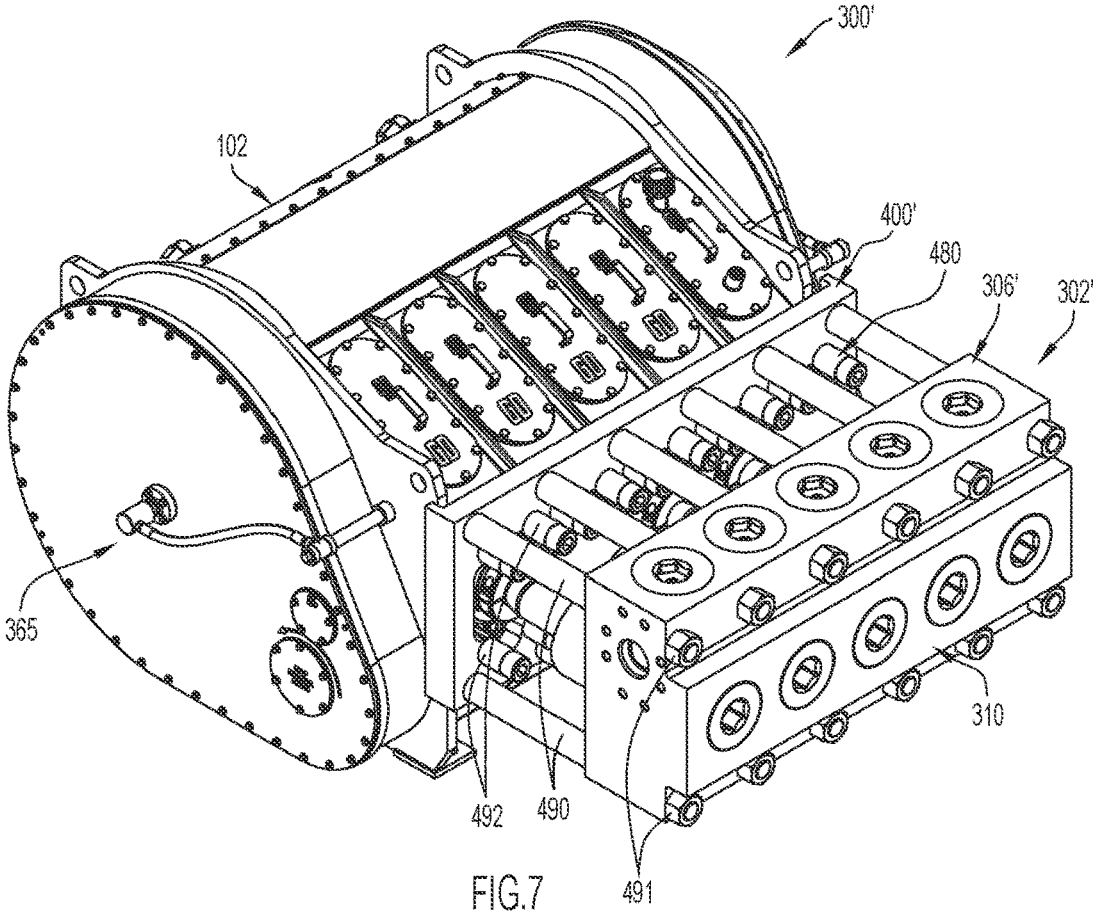
FIG. 7 is a perspective view of another example embodiment of a reciprocating pump including another example mount plate according to the present application.
Figure 8:
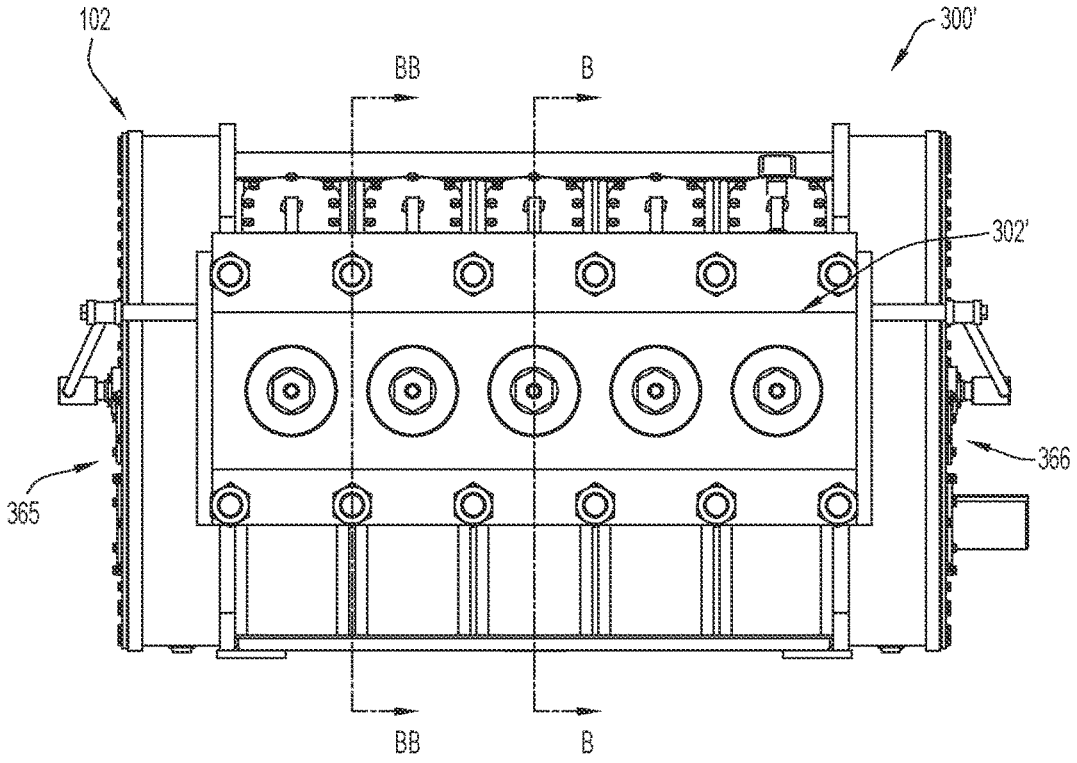
FIG. 8 is a front view of the reciprocating pump illustrated in FIG. 7.
Figure 9A:
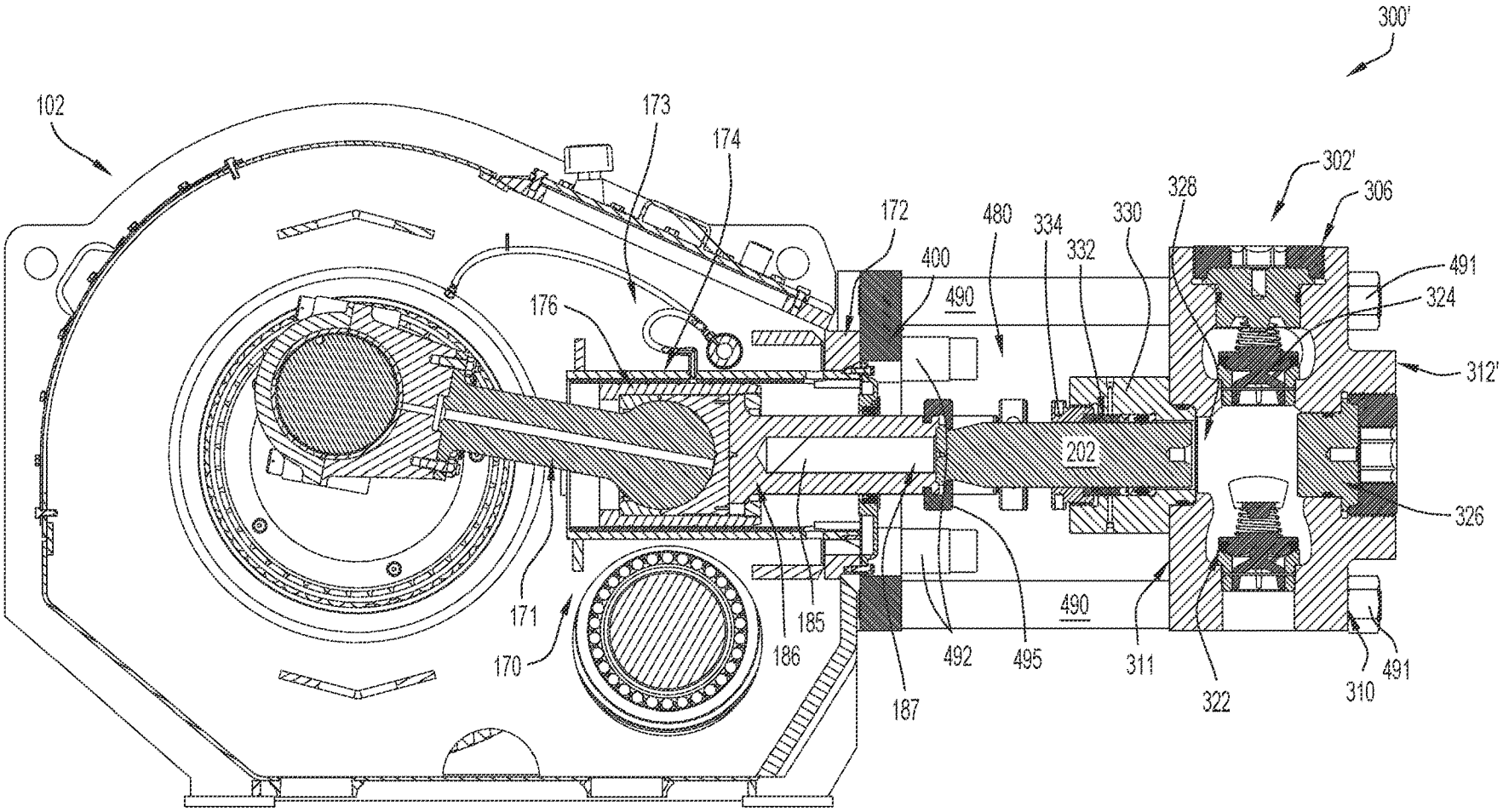
FIG. 9A is a side cross-sectional view of the reciprocating pump illustrated in FIGS. 7 and 8 taken along line "B-B" of FIG. 8.
Figure 9B:
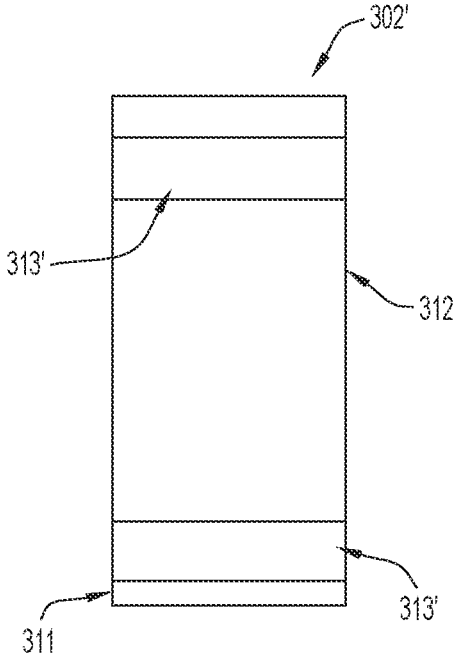
FIG. 9B is a side cross-sectional view of the reciprocating pump illustrated in FIGS. 7, 8, and 9A taken along line "BB-BB" of FIG. 8.

Now turning to FIGS. 6C-6E, as mentioned, each of the openings 430 of a mount plate 400 includes an interior lip 432 on which at least a portion of an oil stop assembly 450 may be mounted. In fact, in the depicted embodiment, the interior lip 432 supports an entire oil stop assembly 450, including a housing 452, a seal element 454, and a retainer 456. The housing 452 has a seating flange 4521 configured to seat on a front surface of interior lip 432 and a seal flange 4522 configured to support/receive the seal element 454. The seating flange 4521 is generally disposed at a radially exterior portion of housing 452 while the seal flange 4522 is disposed on a radially interior portion of housing 452. Between these two flanges, the housing 452 includes a receptacle 4523 within which a fastener 457 can be installed.

Although not explicitly shown, each housing 452 may include a plurality of receptacles 4523, arranged circumferentially around the housing 452. Thus, fasteners 457 can secure the retainer 456 to the housing after a seal element 454 is positioned on the seal flange 4522 to secure the seal element 454 between the seal element 454 and the retainer 456. That is, the seal flange 4522 can engage an upstream/back edge of seal element 454 while the retainer 456 engages a downstream/front edge of the seal element 454, securing the seal element 454 therebetween. Then, the seal element 454 can engage a pony rod 185 and/or a crosshead frame 174 to retain oil in the crosshead assembly 170 of the power end 102. Moreover, in at least some embodiments, the oil stop assembly 450 may be removably coupled to the mount plate 400 with one or more fasteners to further ensure that the seal element 454 is properly positioned to retain oil in the crosshead assembly 170 of the power end 102.

Among other advantages, providing a mount plate 400 that supports the oil stop assembly 450 may reduce the number of parts and/or the amount of material needed to form reciprocating pump 100. Typically (i.e., in pumps without mount plate 400), an oil stop assembly is bolted directly to the power end and transfers stress to the power end frame (e.g., to the nose plate). Additionally, even though such pumps do not have components disposed adjacent to the power end, a support/housing must be provided for the oil stop assembly. Now, since the mount plate 400 is already positioned proximate the power end 102, it can supporting/housing the oil stop assembly 450 without adding an additional component to the overall pump 100.

Moreover, when the oil stop assembly 450 is supported by the mount plate 400, the mount plate 400 will absorb forces/stresses applied to the oil stop assembly 450. This removes stress, strain, and forces from the frame 368 of the power end 102 (e.g., from the nose plate 172), which allows the frame to be formed from weaker and/or less material, saving manufacturing costs. Moving the connection point for the oil stop assembly 450 (e.g., the location at which the oil stop assembly 450 is secured in place relative to a pony rod 185) off the frame 368 of the power end 102 (and to a location accessible from a side of mount plate 400 that faces the fluid end 104) may also make the oil stop assembly 450 easier to access for servicing and/or replacement. Also, with the depicted embodiment, the oil stop assembly 450 can be fully assembled (e.g., retainer 456 can be coupled to housing 452 with a seal element 454 secured therebetween) prior to installation in the reciprocating pump 100. Thus, the oil stop assembly 450 may be relatively easy to install and/or remove. By comparison, if the seal element 454 is installed by itself, it may be difficult to slide the seal element 454 over a pony rod 185. But to be clear, such an arrangement (where seal element 454 is installed independently) is within the scope of this application and may still realize the other advantages discussed herein in connection with oil stop assembly 450.

In fact, the mount plate and oil stop assembly 450 depicted in the Figures are merely one embodiment and other embodiments of the mount plate presented herein need not support an oil stop assembly 450. Alternatively, other embodiments of the mount plate presented herein need not include an interior lip 432, might removably support only a portion of an oil stop assembly 450, and/or may vary from the depicted embodiment in geometry, size, or other manners. As an example, in some embodiments, the interior lip 432 might define the housing 452 (i.e., the housing 452 may be formed integrally with mount plate 400) so that the mount plate 400 removably supports only the seal element 454 and the retainer 456. Alternatively, the mount plate 400 might partially support an oil stop assembly 450 that sits within openings 430, but the oil stop assembly 450 might be coupled to the power end 102 (e.g., to the nose plate 172 or another portion of the frame 368) instead of the mount plate 400. Nevertheless, the pump may still realize the manufacturing advantages discussed above because the mount plate 400 may still absorb the stress, strain, and/or forces acting on the oil stop assembly 450 (e.g., due to laterally surrounding and supporting the oil stop assembly 450) and allow the power end frame to be formed from weaker and/or less material.

Now turning to FIGS. 7, 8, 9A, 9B, and 10, these Figures depict various views of another embodiment of a reciprocating pump 300' with a mount plate 400' that couples a fluid end 302' to power end 102. This embodiment is substantially similar to the embodiment described above in connection with FIGS. 3, 4, 5A, 5B, 6A and 6B. Thus, for brevity, like or similar parts are not described again and any description of parts or features of FIGS. 3, 4, 5A, 5B, 6A and 6B included herein should be understood to apply to like or similar parts of FIGS. 7, 8, 9A, and 9B. For example, mount plate 400' is still coupled to power end 102 with couplers 492 and is still coupled to fluid end 302' with couplers 490. However, now, the fluid end 302' has a casing 306' with a different external shape as compared to casing 306, at least on back side 312', which now has steps to define a contoured shape (as opposed to a back side 312, which is straight). This shaping minimizes the overall size of couplers 490 while extending the access bore 326 to ensure that the access bore 326 has enough space to receive any desired internal components. Additionally, now the through holes 313' of casing 306' (best seen in FIG. 9B) are positioned in different locations as compared to holes 313 of casing 306 (e.g., with more space disposed therebetween). Thus, without mount plate 400 or mount plate 400', power end power end 102 would not be operable with both fluid end 302 and fluid end 302'.

Figure 10:
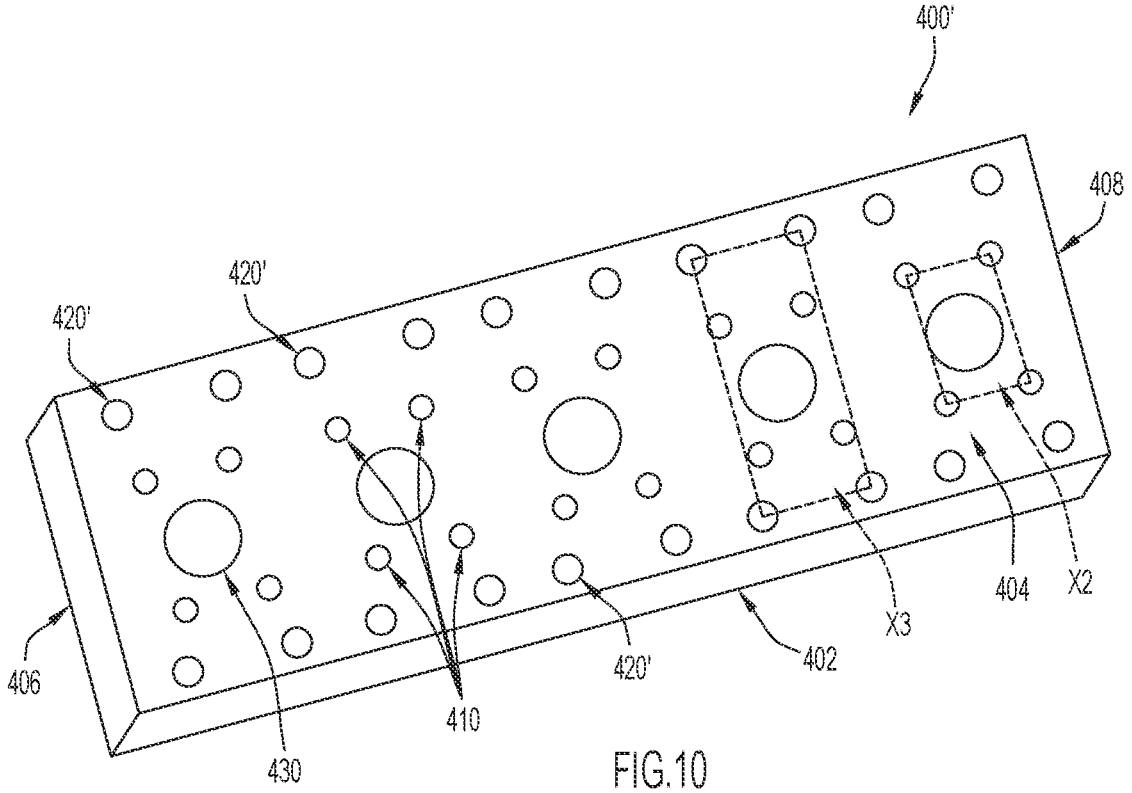
FIG. 10 is a front perspective view of the mount plate included in the reciprocating pump FIGS. 7, 8, 9A, and 9B.

Now turning to FIG. 10 specifically, to allow the power end 102 to be coupled to the holes 313' of fluid end casing 306', the openings 420' are disposed in a different arrangement as compared to openings 420 of mount plate 400. However, at the same time, openings 410 are still positioned at corners of space X2 so that the couplers 492 continue to algin with receptacles 1730 included at front 369 of frame 368. Thus, openings 420' are now positioned exteriorly (e.g., radially exteriorly) of openings 410 and define a space X3 that is larger than space X1. This may create a cradle 480 with a larger longitudinal dimension and, thus, may create more space in the cradle 480. Moreover, even though the openings 410 are positioned within space X3, the longitudinal extension of couplers 492 past the front surface 404 of mount plate 400' may be limited and, thus, the couplers 492 may not substantially reduce the space of the cradle 480. That is, the space gained by longitudinally expanding space X1 to the dimensions defined by space X3 may outweigh the space lost from couplers 492 being disposed in space X3.

Figure 11:
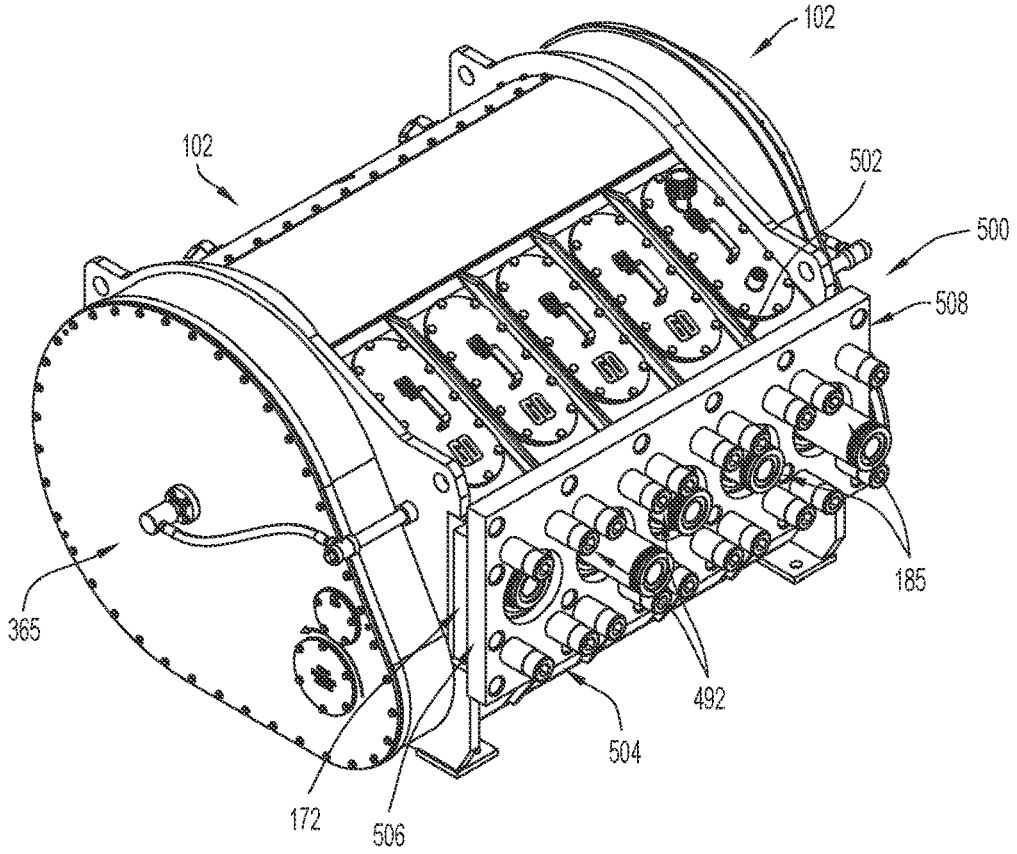
FIG. 11 is a front perspective view of a power end including another example mount plate according to the present application.
Figure 12:
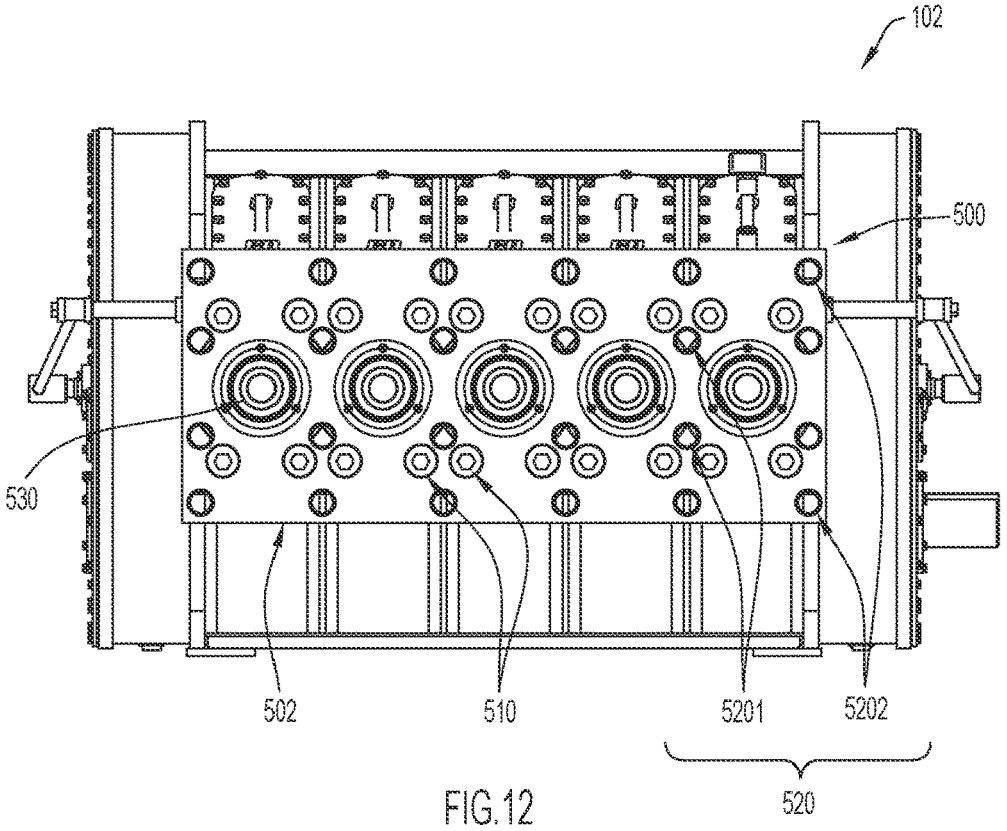
FIG. 12 is a front view of the power end of FIG. 11.

Now turning to FIGS. 11 and 12, which depict perspective and front views of yet another embodiment of a mount plate coupled to power end 102, the above embodiments that depict openings 420 and openings 420' in different locations are not mutually exclusive options for different mount plates. Thus, as an example, mount plate 500 depicts an embodiment where the second set of openings 520 includes a first subset of second openings 5201 (which may also be referred to as a second set of openings) and a second subset of second openings 5202 (which may also be referred to as a fourth set of openings). Each subset of openings 5201 and 5202 may receive couplers 490 that connect the mount plate 500 to a fluid end, such as fluid end 302 or fluid end 302'. Thus, mount plate 500 provides two compatibility options. First, the first subset of second openings 5201 allows the mount plate 500 to couple power end 102 to a fluid end with narrow through holes (or other such receptacles), such as holes 313 of fluid end casing 306. Next, the second subset of second openings 5202 allows the mount plate 500 to couple power end 102 to a fluid end with widely spread through holes (or other such receptacles), such as holes 313' of fluid end casing 306'.

Despite this difference, mount plate 500 is otherwise substantially similar to mount plate 400 and mount plate 400'. For example, mount plate 500 has a main body that extends from a front surface 504 to a back surface 502 that abuts (or is at least proximate to) a power end 102 when coupled thereto (e.g., via couplers 492). Additionally, mount plate 500 extends from a first end 506 to a second end 508 and both ends may align with, extend past, or terminate within the lateral bounds of front 369 of frame 368 (e.g., as defined by sides 365 and 366). Finally, the mount plate 500 may include a first set of openings 510 configured to align with receptacles 1730 included on a front 369 of frame 368 and a third set of openings 530 configured to allow pony rods 185 and/or reciprocating elements 202 to move therethrough.

Figure 13:
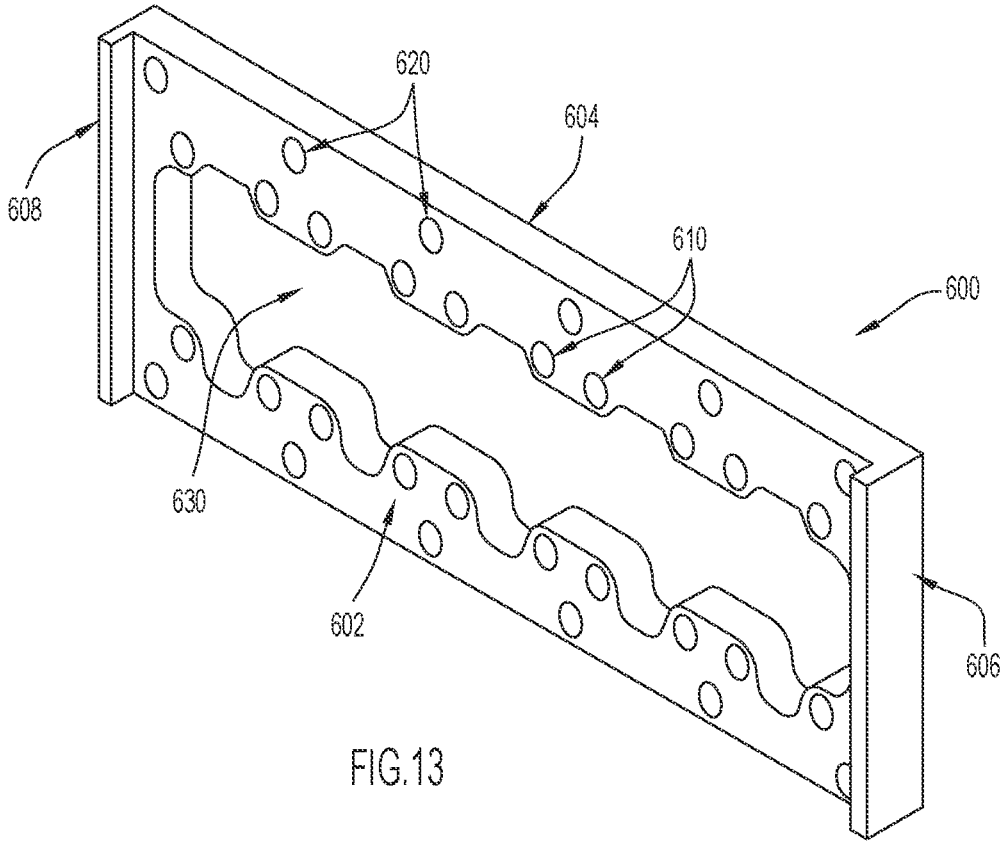
FIGS. 13 and 14 are rear perspective and front views of yet another example mount plate according to the present application.
Figure 14:
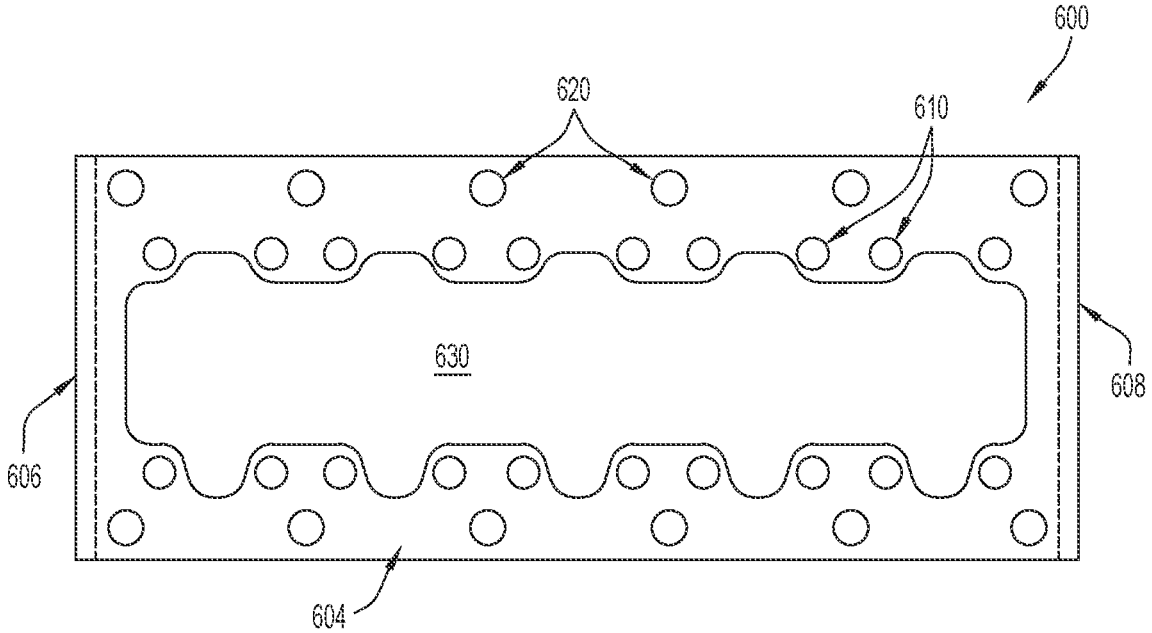

FIGS. 13 and 14 depict rear perspective and front views of yet another embodiment of a mount plate that may be coupled to a power end, such as power end 102. Most notably, in this embodiment, the mount plate 600 includes third openings that are connected and form a continuous opening or slot 630. Or, from another perspective, the third openings are replaced by a contiguous slot 630. The slot 630 is configured to receive multiple pony rods that extends from a power end, but does not interfere with a first set of openings 610 configured to receive couplers (e.g., couplers 492, such as bolts) for coupling the mount plate 600 to a power end. Nor does slot 630 interfere with a second set of openings 620 configured to receive elongate couplers (e.g., couplers 490, such as tie rods) that couple the mount plate 600 to a fluid end.

Despite this difference, mount plate 600 is otherwise substantially similar to other mount plates depicted in this application, such as mount plate 400. For example, mount plate 600 has a main body that extends from a front surface 604 to a back surface 602 that abuts (or is at least proximate to) a power end when coupled thereto (e.g., via couplers 492). Additionally, mount plate 600 extends from a first end 606 to a second end 608 and both ends may align with, extend past, or terminate within the lateral bounds of a front of frame of power end (e.g., as defined by sides of the power end frame). However, notably, in this embodiment, first end 606 and second end 608 each include flange-style extensions that extends away from the back surface 602 and, thus, may at least partially extend or wrap around a portion of a front of a frame of a power end, such as nose plate 172. Such flanges, of any size or shape, may also be included in any other embodiment of a mount plate, including mount plates 400, 400', and 500.

Figure 15:
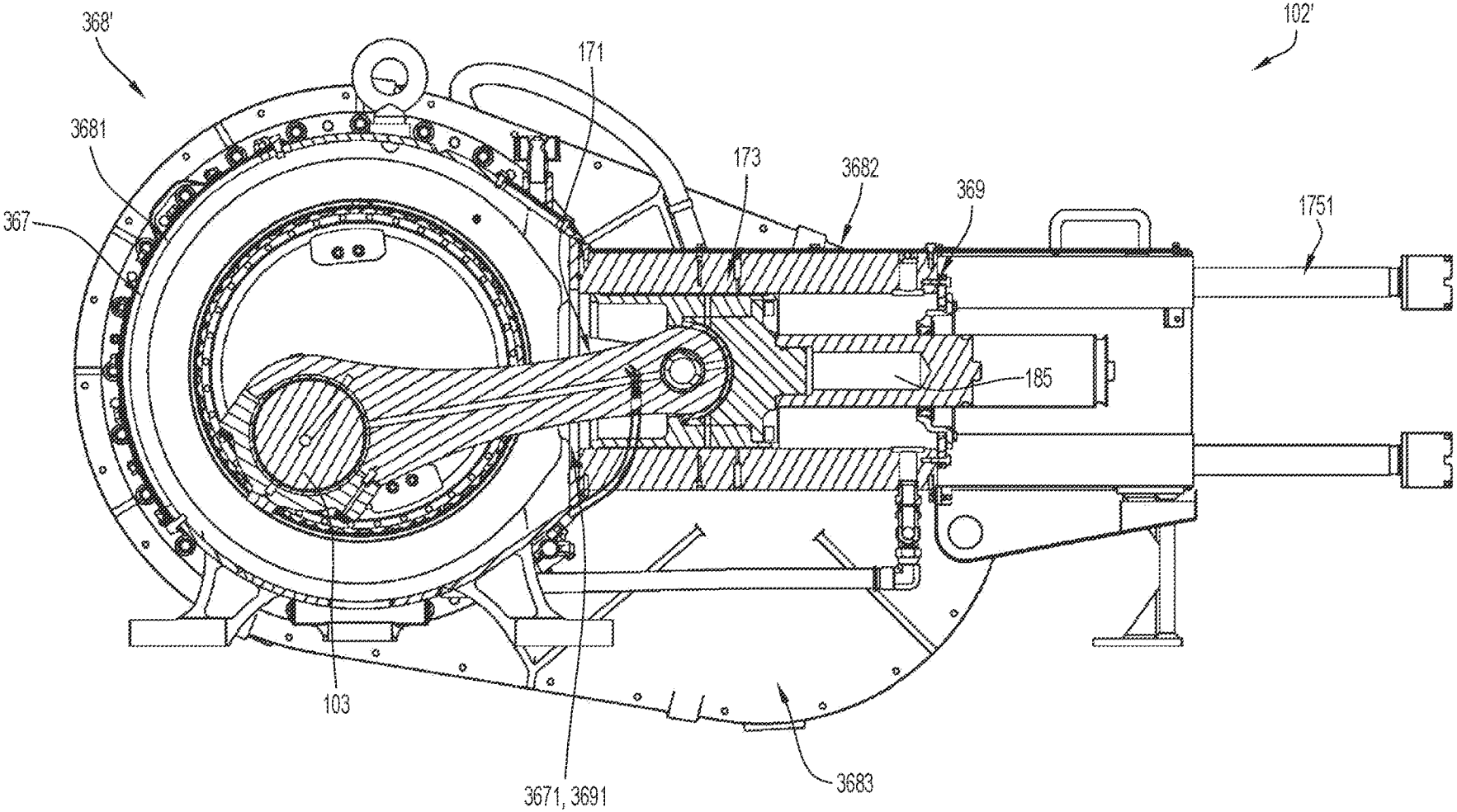
FIG.15 PRIOR ART
FIG. 15 is a front perspective view of another example prior art power end with which the mount plate of the present application may be used.

Now turning to FIG. 15, as mentioned, some power ends need not include a nose plate but may still utilize a mount plate formed in accordance with the present application. FIG. 15 illustrates an example of such a power end 102'. In this power end 102', the frame 368' is formed from sub-portions or sub-frames. Specifically, the frame 368' includes a first portion 3681 that houses the crankshaft 103, a second portion 3682 that houses the crosshead 173, and may also include a third portion 3683 that houses a gear assembly. Overall, the first frame portion 3681 and the second frame portion 3682 define a longitudinal dimension of the frame 368', with a front 3691 of frame portion 3681 being coupled to a back 3671 of frame portion 3682. Thus, the back 367 of the frame 368' is defined by the first frame portion 3681 and the front 369 of the frame 368' is defined by the second frame portion 3682. However, for the purposes of this application, both the overall front 369 of frame 368' and the front of any frame portion, such as the front 3691 of frame portion 3681, may be referred to as a "front of the frame" or variations thereof.

This is because a mount plate could conceivably be mounted to a front of frame portion 3681, frame portion 3682, or any other frame portion (e.g., of any other configuration of any other embodiment). For example, a mount plate of the present application might be positioned at the front 369 of the frame 368' but could be coupled to the front 3691 of frame portion 3681. Alternatively, a mount plate of the present application might be positioned at the front 369 of frame 368' while also be coupled to the front 369 of frame 368' (which, notably, does not include a nose plate). Still further, a mount plate of the present application might be positioned at the front 3691 of frame portion 3681 while also being coupled to the front 3691 of frame portion 3681 (which also does not include a nose plate). In any case, mounting the mount plate of the present application to frame 368' may allow couplers 1751, which typically connect frame 368' in a specific arrangement in order to connect a fluid end to power end 102', to be replaced with elongate couplers (e.g., couplers 490) in any desired arrangement. This will improve the compatibility and serviceability of the power end for the reasons described herein. Moreover, FIG. 15 merely illustrates one example power end 102' with a multi-part frame 368' and, in other embodiments, a power end may include any number of frame portions or configurations on which the mount plate of the present application may be mounted.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A power end for a reciprocating pump, the power end comprising:

a frame that extends from a front to a back; and a mount plate disposed proximate the front of the power end frame, the mount plate including a first set of openings, a second set of openings, and a third set of openings, wherein the first set of openings is configured to receive a first set of couplers that couple the mount plate to the front of the power end, the second set of openings is configured to receive a second set of couplers that couple the mount plate to a fluid end in a spaced relationship, each third opening of the third set of openings is configured to receive a pony rod of the power end and all or a portion of an oil stop assembly that is removably installable into a respective third opening from a side of the mount plate that faces the fluid end.

2. The power end of claim 1, wherein: (a) the first set of couplers are bolts, (b) the second set of couplers are tie rods, or (c) the first set of couplers are bolts and the second set of couplers are tie rods.

3. The power end of claim 1, wherein each third opening of the third set of openings includes a lip configured to support the oil stop assembly.

4. The power end of claim 1, wherein the oil stop assembly comprises a housing, a seal element, and a retaining element, and the housing is formed integrally with the mount plate in each third opening of the third set of openings.

5. The power end of claim 1, wherein the front of the power end comprises receivers for the first set of couplers, the receivers comprising threaded openings.

6. The power end of claim 1, wherein the first set of openings are disposed around an exterior of each third opening of the third set of openings and the second set of openings are disposed interiorly or exteriorly of a first space bounded by the first set of openings.

7. The power end of claim 1, wherein the fluid end to which the second set of couplers connect is a first fluid end, and the mount plate further comprises a fourth set of openings configured to connect the power end to a second fluid end with receivers in a second alignment that is different from a first alignment in which receivers of the first fluid end are aligned.

8. A mount plate for removably connecting a fluid end of a reciprocating pump to a power end for the reciprocating pump, the mount plate comprising:

a main body configured to be positioned proximate a front of the power end of the reciprocating pump;

a first set of openings configured to receive a first set of couplers that couple the mount plate to the front of the power end;

a second set of openings configured to receive a second set of couplers that couple the mount plate to the fluid end in a spaced relationship; and a third set of openings that are configured to receive pony rods of the power end, and to receive and support at least a portion of oil stop assemblies for the power end, wherein an oil stop assembly of the oil stop assemblies is removably installable into a third opening of the third set of openings from a side of the main body that faces the fluid end.

9. The mount plate of claim 8, wherein the fluid end to which the second set of couplers connect is a first fluid end, and the mount plate further comprises a fourth set of openings configured to connect the power end to a second fluid end with receivers in a second alignment that is different from a first alignment in which receivers of the first fluid end are aligned.

10. The mount plate of claim 8, wherein the third opening includes a lip configured to support the oil stop assembly.

11. The mount plate of claim 8, wherein the oil stop assembly comprises a housing, a seal element, and a retaining element, and the housing is formed integrally with the mount plate in the third opening.

12. The mount plate of claim 8, wherein: (a) the first set of couplers are bolts, (b) the second set of couplers are tie rods, or (c) the first set of couplers are bolts and the second set of couplers are tie rods.

13. The mount plate of claim 8, wherein the first set of openings are disposed around an exterior of each third opening of the third set of openings and the second set of openings are disposed interiorly or exteriorly of a first space bounded by the first set of openings.

14. The mount plate of claim 8, wherein the fluid end has a removable stuffing box and the spaced relationship provides access to the removable stuffing box without decoupling the first set of couplers from the power end or the mount plate and without decoupling the second set of couplers from the mount plate or the fluid end.

15. A reciprocating pump, comprising:

a power end configured to generate a pumping power;

a fluid end including a casing configured to guide pumped fluid as the power end generates the pumping power; and a mount plate disposed proximate the power end and coupled thereto, the mount plate including a first set of openings configured to receive a set of elongate couplers that couple the mount plate to the casing in a spaced relationship and extend through the casing so that the set of elongate couplers can be secured to the casing at an external surface of the casing.

16. The reciprocating pump of claim 15, wherein the set of elongate couplers are tie rods.

17. The reciprocating pump of claim 15, wherein the mount plate further comprises another set of openings configured to receive pony rods of the power end and to also receive and support at least a portion of an oil stop assembly, the first set of openings being disposed exteriorly of a space bounded by said another set of openings.

18. The reciprocating pump of claim 15, wherein the fluid end comprises receivers for the set of elongate couplers, the receivers comprising through holes that extend from a front of the casing of the fluid end to a back of the casing.

19. The reciprocating pump of claim 15, wherein the fluid end has a removable stuffing box and the spaced relationship provides access to the removable stuffing box without decoupling the power end from the mount plate and without decoupling the set of elongate couplers from the mount plate or the fluid end.

20. The reciprocating pump of claim 15, wherein the mount plate further comprises another set of openings configured receive a first set of couplers that couple the mount plate to the power end.

* * * * *